US010619319B2

(12) United States Patent
Anderson, Jr. et al.

(10) Patent No.: US 10,619,319 B2
(45) Date of Patent: Apr. 14, 2020

(54) FLOOD VENT

(71) Applicant: Smart Vent Products, Inc., Pitman, NJ (US)

(72) Inventors: Winfield Scott Anderson, Jr., Palm Beach Gardens, FL (US); Tom Little, Pitman, NJ (US); James Rycek, Pitman, NJ (US); Michael J. Graham, Pitman, NJ (US)

(73) Assignee: SMART VENT PRODUCTS, INC., Pitman, NJ (US)

( * ) Notice: Subject to any disclaimer, the term of this patent is extended or adjusted under 35 U.S.C. 154(b) by 0 days.

(21) Appl. No.: 16/173,611

(22) Filed: Oct. 29, 2018

(65) Prior Publication Data

US 2019/0063025 A1 Feb. 28, 2019

Related U.S. Application Data

(63) Continuation of application No. 15/489,100, filed on Apr. 17, 2017, now Pat. No. 10,113,286, which is a (Continued)

(51) Int. Cl.
*E02B 7/40* (2006.01)
*E04B 1/70* (2006.01)
(Continued)

(52) U.S. Cl.
CPC ..... *E02B 7/40* (2013.01); *E04B 1/7076* (2013.01); *F24F 13/14* (2013.01); *E06B 2009/007* (2013.01); *F24F 13/082* (2013.01)

(58) Field of Classification Search
CPC .... E04B 1/7038; E04B 1/7076; E04B 1/7092; E02B 7/40
See application file for complete search history.

(56) References Cited

U.S. PATENT DOCUMENTS 73,159 A 1/1868 Besse
100,623 A 3/1870 Hays
(Continued)

FOREIGN PATENT DOCUMENTS

AU 2008100183 5/2008
EP 2273056 1/2011
(Continued)

OTHER PUBLICATIONS

Smart Vent, web pages from www.smartvent.com, printed Apr. 6, 2015.

(Continued)

*Primary Examiner* — Catherine A Kelly
(74) *Attorney, Agent, or Firm* — Akerman LLP

(57) ABSTRACT

According to one embodiment, a flood vent includes a frame forming a fluid passageway through an opening in a structure. The flood vent further includes a door pivotally mounted to the frame in the fluid passageway for allowing a fluid to flow through the fluid passageway. The door has two opposing faces that include a first face and a second face. The flood vent further includes a first float positioned within the door in a location in-between the first face and a second float. Additionally, the first float is configured to allow the door to pivot in a first direction. The flood vent further includes the second float positioned within the door in a location in-between the second face and the first float. Furthermore, the second float is configured to allow the door to pivot in a second direction.

6 Claims, 7 Drawing Sheets

Related U.S. Application Data continuation of application No. 14/681,220, filed on Apr. 8, 2015, now Pat. No. 9,624,637.

(51) Int. Cl.

| | |
|---|---|
| ***F24F 13/14*** | (2006.01) |
| *E06B 9/00* | (2006.01) |
| *F24F 13/08* | (2006.01) |

(56) References Cited

U.S. PATENT DOCUMENTS

| | | | | | |
|---|---|---|---|---|---|
| 314,865 | A | | 3/1885 | Monger | |
| 735,053 | A | | 8/1903 | Bates | |
| 850,441 | A | | 4/1907 | McGinnis | |
| 911,290 | A | | 2/1909 | Burkett | |
| 1,089,232 | A | | 3/1914 | Larson | |
| 2,105,735 | A | | 1/1938 | Hodge | |
| 2,118,535 | A | | 5/1938 | Betts | |
| 2,565,122 | A | | 8/1951 | Cowan | |
| 2,611,310 | A | | 9/1952 | Cowan | |
| 2,758,646 | A | * | 8/1956 | Johnson | E06B 7/32 160/354 |
| 2,774,116 | A | | 12/1956 | Wolverton | |
| 2,798,422 | A | | 7/1957 | Bourque | |
| 3,123,867 | A | | 3/1964 | Combs | |
| 3,425,175 | A | | 2/1969 | Gerde | |
| 3,623,614 | A | * | 11/1971 | Schmidt, Jr. | B01D 29/111 210/486 |
| 3,680,329 | A | | 8/1972 | Burtis | |
| 3,683,630 | A | | 8/1972 | Alexandre | |
| 3,927,709 | A | | 12/1975 | Anderson et al. | |
| 3,939,863 | A | | 2/1976 | Robison | |
| 3,942,328 | A | | 3/1976 | Bunger | |
| 3,974,654 | A | | 8/1976 | Mirto et al. | |
| 3,978,616 | A | | 9/1976 | Pennock | |
| 4,048,771 | A | | 9/1977 | Thistlethwaite | |
| 4,116,213 | A | | 9/1978 | Kamezaki | |
| 4,146,346 | A | | 3/1979 | Salo | |
| 4,147,451 | A | * | 4/1979 | Zeiders | E02B 7/40 251/305 |
| 4,174,913 | A | | 11/1979 | Schliesser | |
| 4,227,266 | A | | 10/1980 | Russell | |
| 4,231,412 | A | | 11/1980 | Nowak | |
| 4,290,635 | A | | 9/1981 | McKenzie | |
| 4,349,296 | A | | 9/1982 | Langeman | |
| 4,378,043 | A | | 3/1983 | Sorenson | |
| 4,407,613 | A | * | 10/1983 | Jones | B65G 51/20 137/112 |
| 4,484,728 | A | * | 11/1984 | Moore | E02B 7/20 251/147 |
| 4,549,837 | A | | 10/1985 | Herbert | |
| 4,576,512 | A | | 3/1986 | Combes et al. | |
| 4,606,672 | A | | 8/1986 | LeSire | |
| 4,669,371 | A | | 6/1987 | Sarazen, Jr. et al. | |
| 4,676,145 | A | | 6/1987 | Allred | |
| 4,699,045 | A | | 10/1987 | Hensley | |
| 4,754,696 | A | | 7/1988 | Sarazen et al. | |
| 5,020,567 | A | * | 6/1991 | Proulx | E03F 7/04 137/315.41 |
| 5,171,102 | A | | 12/1992 | De Wit | |
| 5,253,804 | A | | 10/1993 | Sarazen et al. | |
| 5,293,920 | A | | 3/1994 | Vagedes | |
| 5,294,049 | A | | 3/1994 | Trunkle et al. | |
| 5,330,386 | A | | 7/1994 | Calandra | |
| 5,408,789 | A | | 4/1995 | Plfeger | |
| 5,460,572 | A | | 10/1995 | Waltz et al. | |
| 5,487,701 | A | | 1/1996 | Schnedegger et al. | |
| 5,584,993 | A | * | 12/1996 | Van Der Schrieck | B01D 21/0027 210/170.04 |
| 5,904,199 | A | | 5/1999 | Messner | |
| 5,944,445 | A | * | 8/1999 | Montgomery | E04B 1/7076 405/92 |
| 5,994,445 | A | | 11/1999 | Kaschel et al. | |
| 6,092,580 | A | | 7/2000 | Lucas | |
| 6,287,050 | B1 | | 9/2001 | Montgomery et al. | |
| 6,287,051 | B1 | * | 9/2001 | Wood | E02B 7/54 251/193 |
| 6,485,231 | B2 | * | 11/2002 | Montgomery | E02B 7/40 405/92 |
| 6,692,187 | B2 | * | 2/2004 | Sprengle, Sr. | E02B 7/40 405/92 |
| 7,083,359 | B2 | * | 8/2006 | Aughton | E02B 7/26 405/100 |
| 7,270,498 | B1 | * | 9/2007 | Albanese | E04B 1/7076 405/103 |
| 7,600,944 | B1 | * | 10/2009 | Keating | E04H 9/145 405/96 |
| 7,909,686 | B2 | * | 3/2011 | Achen | F24F 13/082 454/277 |
| 8,308,396 | B2 | * | 11/2012 | Shook | E04B 1/7076 405/100 |
| 8,375,664 | B2 | * | 2/2013 | Gower, Sr. | E04B 1/7076 52/169.5 |
| 8,511,938 | B1 | * | 8/2013 | Payne | E04B 1/7076 160/123 |
| 8,936,660 | B2 | * | 1/2015 | Cruz Aguado | F24F 7/00 454/196 |
| 9,341,018 | B2 | * | 5/2016 | Helton | E06B 7/23 |
| 9,624,937 | B2 | | 4/2017 | Makley et al. | |
| 9,637,912 | B1 | * | 5/2017 | Anderson, Jr. | E04B 1/7076 |
| 9,670,717 | B2 | * | 6/2017 | Anderson, Jr. | E04B 1/70 |
| 10,113,286 | B2 | | 10/2018 | Anderson, Jr. et al. | |
| 2002/0021941 | A1 | * | 2/2002 | Montgomery | E02B 7/40 405/100 |
| 2008/0236062 | A1 | * | 10/2008 | Bergaglio | F24F 13/084 52/169.5 |
| 2012/0028564 | A1 | * | 2/2012 | Kelly | E04B 1/7076 454/275 |
| 2012/0174501 | A1 | * | 7/2012 | Malitsky | E06B 9/02 52/169.5 |
| 2012/0264363 | A1 | * | 10/2012 | Ramsay | F24F 7/00 454/359 |
| 2012/0266975 | A1 | * | 10/2012 | Kelly | E04B 1/7038 137/357 |
| 2013/0196589 | A1 | * | 8/2013 | Ramsay | F24F 13/1406 454/359 |
| 2013/0279986 | A1 | * | 10/2013 | Payne | E04B 1/70 405/98 |
| 2014/0109993 | A1 | | 4/2014 | Kelly | |
| 2017/0131126 | A1 | * | 5/2017 | Aughton | E02B 7/26 |

FOREIGN PATENT DOCUMENTS

| | | |
|---|---|---|
| EP | 2290188 | 3/2011 |
| EP | 2365134 | 9/2011 |
| EP | 2374981 | 10/2011 |
| EP | 2458092 | 5/2012 |
| EP | 2764192 | 4/2013 |
| EP | 2634328 | 9/2013 |
| EP | 2647888 | 10/2013 |
| EP | 2662512 | 11/2013 |
| EP | 2682687 | 1/2014 |
| GB | 2147933 | 5/1985 |
| GB | 2397592 | 7/2004 |
| GB | 2461754 | 1/2010 |
| GB | 2466302 | 6/2010 |
| GB | 2498330 | 7/2013 |

OTHER PUBLICATIONS

Smart Vent, product literature "Smart Vent Foundation Flood Vents vs. Flood Flaps" printed Apr. 6, 2015.

FEMA, Openings in Foundation Walls and Walls of Enclosures, Technical Bulletin 1, Aug. 2008.

FEMA, Non-Residential Floodproofing, Technical Bulletin 3, Apr. 1993.

Smart Vent, "Foundation Flood Vents" printed Apr. 6, 2015.

Smart Vent, Product Catalog printed Apr. 6, 2015.

(56) References Cited

OTHER PUBLICATIONS

Wayback machine archive of Smart Vent website product catalog for insulated flood vent, May 14, 2012.

* cited by examiner

FLOOD VENT

CROSS REFERENCE TO RELATED APPLICATIONS

This application is a continuation application and claims the benefit of the filing date under 35 U.S.C. § 120 of U.S. patent application Ser. No. 15/489,100, filed on Apr. 17, 2017, which is a continuation of U.S. patent application Ser. No. 14/681,220, filed on Apr. 8, 2015, now U.S. Pat. No. 9,624,637, the entirety of both of which are incorporated herein by reference.

TECHNICAL FIELD

This invention relates generally to flood water control devices and more particularly to a flood vent.

BACKGROUND

Typically, one or more flood vents may be installed into an opening in a structure (such as a building) in order to provide for equalization of interior and exterior hydrostatic forces caused by flooding fluids, such as water. Such typical flood vents may include a flood vent door that may open to allow flooding fluids to pass into or out of the structure through the flood vent, but that may prevent animals or other pests from entering or exiting the structure through the flood vent. These typical flood vents, however, may be deficient.

SUMMARY

According to one embodiment, a flood vent includes a frame forming a fluid passageway through an opening in a structure. The flood vent further includes a door pivotally mounted to the frame in the fluid passageway for allowing a fluid to flow through the fluid passageway. The flood vent also includes one or more pieces of foam insulation extending at least substantially along an entire length of an inner perimeter of the frame. The one or more pieces of foam insulation are positioned on the inner perimeter of the frame in a location that is exterior to the door.

Certain embodiments of the disclosure may provide one or more technical advantages. For example, the flood vent includes one or more pieces of foam insulation extending at least substantially along an entire length of an inner perimeter of the frame, and positioned on the inner perimeter of the frame in a location that is exterior to the door. In particular embodiments, such a positioning of the insulation may further prevent air from entering and/or exiting the structure through the flood vent.

According to another embodiment, a flood vent includes a frame forming a fluid passageway through an opening in a structure. The flood vent further includes a door pivotally mounted to the frame in the fluid passageway for allowing a fluid to flow through the fluid passageway. The flood vent further includes one or more pieces of rubber liner extending at least substantially along an entire length of an inner perimeter of the frame, the one or more pieces of rubber liner being positioned on the inner perimeter of the frame in a location that is interior to the door.

Certain embodiments of the disclosure may provide one or more technical advantages. For example, the flood vent includes one or more pieces of rubber liner extending at least substantially along an entire length of an inner perimeter of the frame, and positioned on the inner perimeter of the frame in a location that is interior to the door. In particular embodiments, such a positioning of the rubber liner may further prevent air from entering and/or exiting the structure through the flood vent.

According to a further embodiment, a flood vent includes a frame forming a fluid passageway through an opening in a structure. The flood vent further includes a door pivotally mounted to the frame in the fluid passageway for allowing a fluid to flow through the fluid passageway. The door has an outer perimeter defined by a top edge of the door, a bottom edge of the door, a first side edge of the door, and a second side edge of the door. The flood vent further includes one or more pieces of insulation positioned on each of the top edge of the door, the bottom edge of the door, the first side edge of the door, and the second side edge of the door. The one or more pieces of insulation extend at least substantially along an entire length of the outer perimeter of the door.

Certain embodiments of the disclosure may provide one or more technical advantages. For example, the flood vent includes one or more pieces of insulation that extend at least substantially along an entire length of the outer perimeter of a door of the flood vent. In particular embodiments, such a positioning of the insulation may further prevent air from entering and/or exiting the structure through the flood vent.

According to a further embodiment, a system includes a first frame forming a first portion of a fluid passageway through an opening in a structure. The first frame is configured to be installed on an exterior side of the structure. The system also includes a first door pivotally mounted to the first frame in the fluid passageway for allowing a fluid to flow through the fluid passageway. The system further includes a second frame forming a second portion of the fluid passageway through the opening in the structure. The second frame is configured to be installed on an interior side of the structure. The system further includes a second door pivotally mounted to the second frame in the fluid passageway for allowing the fluid to flow through the fluid passageway. The system further includes one or more pieces of rubber liner positioned on each of a top edge of the second door, a bottom edge of the second door, a first side edge of the second door, and a second side edge of the second door.

Certain embodiments of the disclosure may provide one or more technical advantages. For example, the system includes a second frame inserted on an interior side of a structure and having a second door with one or more pieces of rubber liner positioned on each of a top edge of the second door, a bottom edge of the second door, a first side edge of the second door, and a second side edge of the second door. In particular embodiments, the second door may provide an aesthetically pleasing cover to the opening in the interior side of the structure. Furthermore, in particular embodiments, the second door may allow fluids to enter and/or exit the structure without a user having to remove a removable cover first. Additionally, in particular embodiments, the positioning of the rubber liner on the second door may further prevent air from entering and/or exiting the structure through the flood vent.

According to a further embodiment, a flood vent includes a frame forming a fluid passageway through an opening in a structure. The flood vent further includes a door pivotally mounted to the frame in the fluid passageway for allowing a fluid to flow through the fluid passageway. Additionally, the door includes a rubber panel, and two or more metal panels positioned within a perimeter of the rubber panel.

Certain embodiments of the disclosure may provide one or more technical advantages. For example, the flood vent includes a door with a rubber panel, and two or more metal panels positioned within a perimeter of the rubber panel. In particular embodiments, the rubber panel may have a flexibility that allows the seal between the flexible panel and the frame to be more easily broken. Furthermore, in particular embodiments, the metal panels may increase the rigidity (or decrease the flexibility) of the flexible panel so as to create resistance to opening of the flexible panel, but still allowing the flexible panel to be flexible. As such, the flexible panel may remain flexible (e.g., thereby allowing the seal between the flexible panel and the frame to be more easily broken), but the flexible panel may still be prevented from being opened by pests or a minor amount of fluids.

According to a further embodiment, a flood vent includes a frame forming a fluid passageway through an opening in a structure. The flood vent further includes a door pivotally mounted to the frame in the fluid passageway for allowing a fluid to flow through the fluid passageway. The door has two opposing faces that include a first face and a second face. The flood vent further includes a first float positioned within the door in a location in-between the first face and a second float. Additionally, the first float is configured to allow the door to pivot in a first direction. The flood vent further includes the second float positioned within the door in a location in-between the second face and the first float. Furthermore, the second float is configured to allow the door to pivot in a second direction.

Certain embodiments of the disclosure may provide one or more technical advantages. For example, the flood vent includes a first float positioned within the door in a location in-between the first face and a second float, and the second float positioned within the door in a location in-between the second face and the first float. In particular embodiments, the first and second floats may allow the door to be locked vertically (as opposed to horizontally), which may prevent additional gaps between the door and the frame. As such, the floats may further prevent air from entering and/or exiting the structure. Additionally, in particular embodiments, the flood vent may also include insulation, which may also further prevent air from entering and/or exiting the structure Certain embodiments of the disclosure may include none, some, or all of the above technical advantages. One or more other technical advantages may be readily apparent to one skilled in the art from the figures, descriptions, and claims included herein.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Embodiments of the present disclosure are best understood by referring to FIGS. 1-8 of the drawings, like numerals being used for like and corresponding parts of the various drawings.

Figure 1B:
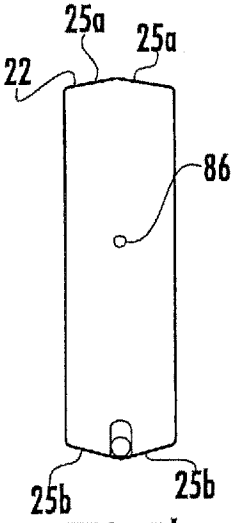
FIG. 1*b* illustrates a side view of the door of FIG. 1*a*.
Figure 1A:
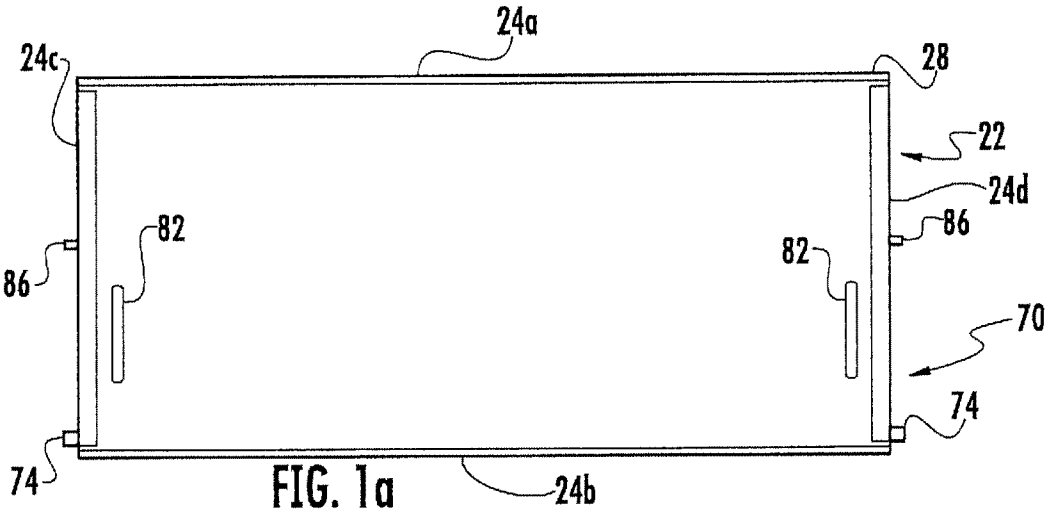
FIG. 1*a* illustrates a front view of a door of an example flood vent.
Figure 2B:
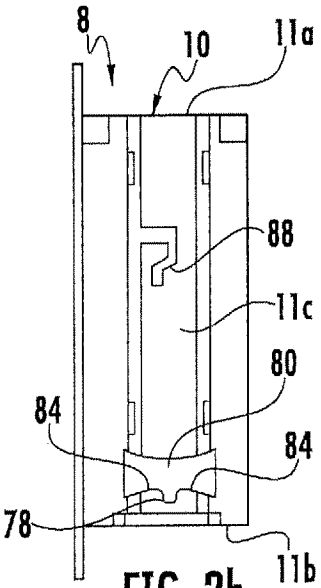
FIG. 2*b* illustrates a side view of the frame of FIG. 2*a*.
Figure 2A:
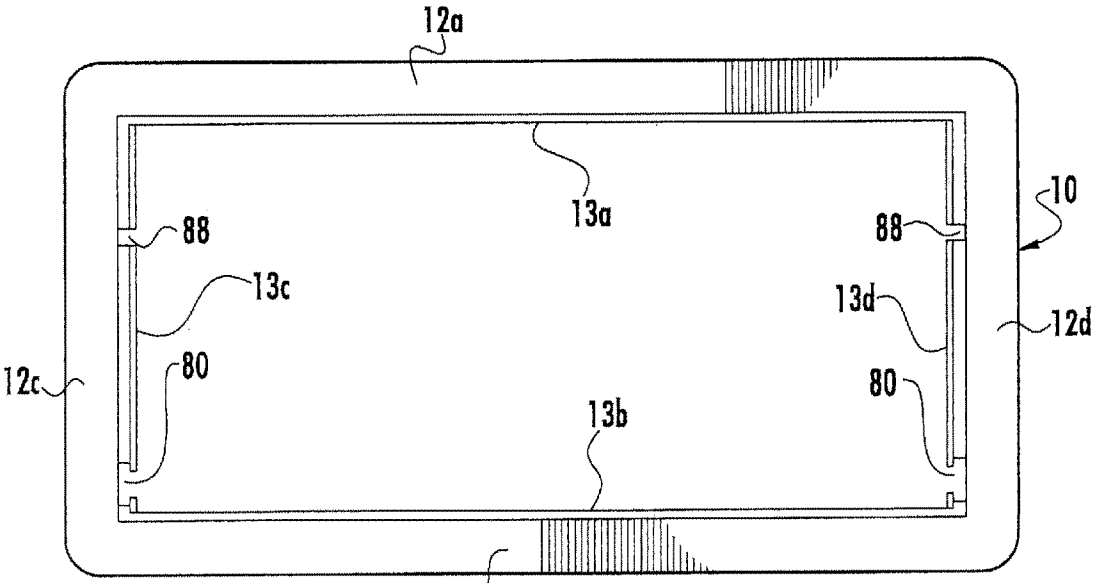
FIG. 2*a* illustrates a front view of a frame of an example flood vent.
Figure 3A:
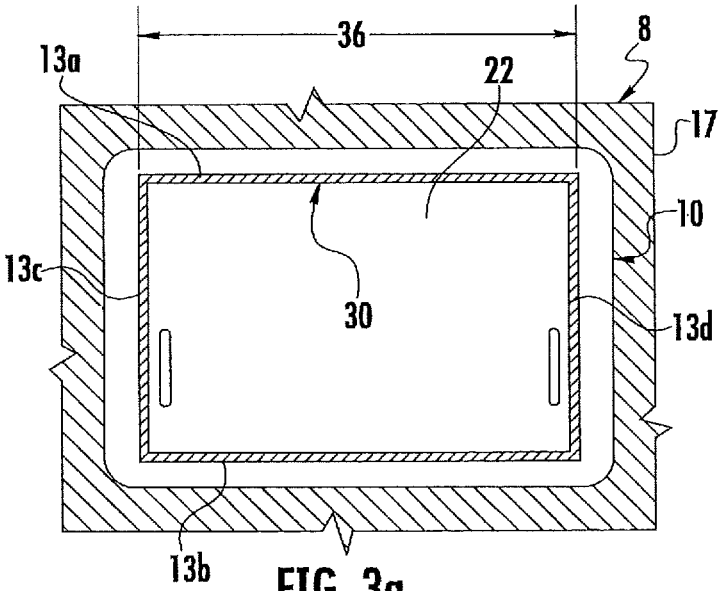
FIGS. 3*a*, 3*b*, 3*c*, and 3*d* illustrate the flood vent of FIGS. 1-2 having example insulation.
Figure 3B:
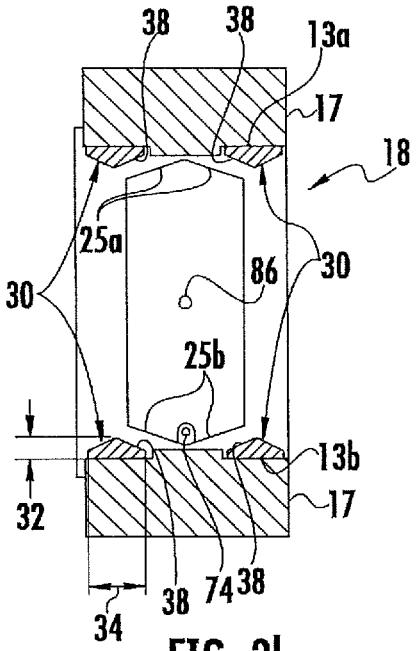

FIGS. 1 and 2 illustrate an example of a flood vent 8. The flood vent 8 may be inserted (or otherwise installed) into an opening in a structure, such as an opening in a building, a wall, a foundation, a basement, a garage, a foyer, an entry, any structure located below base flood plain levels, any other structure, or any combination of the preceding. An example of the flood vent 8 inserted (or otherwise installed) into an opening in a structure is illustrated in FIGS. 3*a*-3*b*, which illustrate flood vent 8 as being inserted (or otherwise installed) into opening 18 in structure 17. The flood vent 8 may provide an entry point and/or exit point in the structure for flooding fluids, such as water. As such, the flood vent 8 may provide equalization of interior and exterior hydrostatic forces caused by the flooding fluids. In particular embodiments, the flood vent 8 may comply with various building code and federal government regulations that mandate that buildings with enclosed spaces located below base flood plain levels, such as crawl spaces, must provide for automatic equalization of interior and exterior hydrostatic forces caused by flooding fluids. According to these regulations, flooding fluids must be permitted to enter and exit the enclosed spaces freely using flood venting.

As illustrated, the flood vent 8 includes a frame 10 and a door 22. The frame 10 may form a fluid passageway through the opening in the structure, thereby allowing the flooding fluids to enter and/or exit the structure. The frame 10 includes a top edge 11*a*, a bottom edge 11*b*, and two side edges 11*c* and 11*d* (not shown). The edges 11 may define an outer perimeter of the frame 10. The frame 10 further includes a top rail 12*a*, a bottom rail 12*b*, and side rails 12*c* and 12*d*. When the flood vent 8 is inserted (or otherwise installed) in the opening in the structure, the edges 11 of the frame 10 may be positioned (entirely or partially) within the opening of the structure (as is seen in FIGS. 3*a*-3*b*), and the rails 12 may be positioned (entirely or partially) outside the opening of the structure (as is further seen in FIGS. 3*a*-3*b*). The frame 10 also includes a top interior edge 13*a*, a bottom interior edge 13*b*, and two side interior edges 13*c* and 13*d*. The interior edges 13 of the frame 10 may define an inner perimeter of the frame 10. Furthermore, although the flood vent 8 is illustrated as including a single frame 10 and a single door 22, the flood vent 8 may include multiple frames 10 and/or multiple doors 10. For example, the flood vent 8 may include two frames 10 (or two or more frames 10) stacked on top of each other (and coupled together), along with one or more doors 22 attached to each frame 10. As another example, the flood vent 8 may include two frames 10 (or two or more frames 10) positioned horizontally next to each other (and coupled together), along with one or more doors 22 attached to each frame 10. As a further example, the flood vent 8 may include two frames 10 (or two or more frames 10) stacked on top of each other and two frames 10 (or two or more frames 10) positioned horizontally next to each other (and these four or more frames 10 may be coupled together), along with one or more doors 22 attached to each frame 10.

The frame 10 may have any shape. For example, the frame 10 may be rectangular-shaped. The frame 10 may also have any dimensions. For example, the top and bottom edges 11*a* and 11*b* may be approximately 16" long, and the side edges 11*c* and 11*d* may be approximately 8" long, thereby forming an 8"×16" rectangular outer perimeter. Furthermore, the top and bottom rails 12*a* and 12*b* may be approximately 17 11/16" long, and the side rails 12*c* and 12*d* may be approximately 9 11/16" long. Additionally, when two or more frames 10 are coupled together (as is discussed above), the flood vent 8 may have an outer perimeter of, for example, approximately 16"×16", 8"×32", 16"×32", or any other dimensions. The frame 10 may be formed of any material. For example, the frame 10 may be formed of a corrosion resistant material, such as stainless steel, spring steel, plastic, a polymer, any other corrosion resistant material, or any combination of the preceding.

The flood vent 8 further includes a door 22 attached to the frame 10 (or multiple doors 22 attached to multiple frames 10). The door 22 may be pivotally mounted to the frame 10, thereby allowing the door 22 to pivot relative to the frame 10. The door 22 may be mounted to the frame 10 in any manner that allows the door 22 to pivot relative to the frame 10. For example, the door 22 may include one or more door pins 86 that extend from the door 22. In such an example, the door pins 86 may be configured to be received within door slots 88 which may be disposed within the frame 10. As shown in FIG. 2*b*, the door slots 88 may be ?-shaped. As another example, the door slots 88 may be T-shaped. Such configurations may allow the door pins 86 to rise in the door slots 88, thereby permitting the door 22 to rise in response to flooding. Furthermore, such configurations may prevent the door 22 from being easily removed during flooding conditions and can deter entry by unauthorized persons or pests.

The door 22 may include solid panels disposed on opposing faces of the door 22, as is illustrated in FIG. 1*a*. The solid panels may prevent (or substantially prevent) air from passing through the door 22, as well as prevent (or substantially prevent) objects, such as small animals, from passing through the door 22. Although the door 22 is illustrated as including solid panels, the door 22 may include any other type of panels. For example, the door 22 may include mesh grille panels (not shown) that include openings that may allow air to pass through the door. In such an example, the size of the openings may be sufficiently small to prevent (or substantially prevent) objects such as small animals from passing through the door 22. As another example, the door 22 may include one or more louvers (such as, for example, four louvers, or any other number of louvers) that may be opened to allow air to pass through the door 22 (e.g., during warmer temperatures), and closed to prevent (or substantially prevent) air from passing through the door 22 (e.g., during colder temperatures). Additionally, the louvered door 22 may be screened to prevent (or substantially prevent) penetration by small animals. Further details regarding louvers (and the operation of such louvers) is included in U.S. Pat. No. 6,692,187 entitled "Flood Gate For Door," which is incorporated herein by reference.

The door 22 further includes a top edge 24*a*, a bottom edge 24*b*, and two side edges 24*c* and 24*d*. The edges 24 of the door 22 may define an outer perimeter of the door 22. The edges 24 of the door 22 may have any shape. As an example, the edges 24 of the door 22 may be flat, curved, angled, or any combination of the preceding. As illustrated in FIG. 1*b*, top edge 24*a* and bottom edge 24*b* may each include two portions 25 that are angled and meet at a point. The angled portions 25*a* of top edge 24*a* and the angled portions 25*b* of bottom edge 24*b* may have any angle.

As is discussed above, the flood vent 8 may provide an entry point and/or exit point in the structure for flooding fluids, such as water. In order to do so, the flood vent 8 may include a latching mechanism 70 that may release the door 22 (or multiple latching mechanisms 70 that respectively release one of multiple doors 22 of the flood vent 8), thereby allowing the door 22 to open. The latching mechanism 70 may operate by sensing the level or flow of fluids, such as water, passing through the opening in the structure and, at a preset level, may release the door 22. At a time when the level of fluid has decreased sufficiently so that the door 22 hangs substantially perpendicular to the ground, the latching mechanism 70 may be reset, which in turn may return the door 22 to its pre-release position. The latching mechanism 70 may include any type of device (or combination of devices) that may perform the above discussed functions. As an example, the latching mechanism 70 may include one or more floats (not shown) that may be lifted and/or lowered by the height or flow of fluid through fluid openings 82 in the door 22. The pin 74 extending from each float may be adapted to be inserted into an open slot 78 in the frame 10. When the pin 74 is positioned within the open slot 78, the door 22 may be prevented from swinging in either direction. Once the float is lifted by the height or flow of the fluid such that the pin 74 exits the opening of the open slot 78 (or to any other preset level), the pin 74 may no longer be constrained by the open slot 78, and the door 22 may rotate in the direction of the current of the fluid. The frame 10 may also include a channel 80 which may allow the pin 74 to pass through the frame 10 as the door 22 rotates. Furthermore, use of the float, pin 74, and open slot 78 may also act as a resetting mechanism. For example, one or more guides 84 may be disposed on the frame 10. The guides 84 may be used to position the pin 74 in the open slot 78. The guides 84 may be used when the door 22 returns to a substantially perpendicular position, which may occur when the level of fluid is lower than the opening in the open slot 78. The guides 84, which may be disposed on both sides of the open slot 78, may be angled upward to position the pin 74 upward as the door 22 rotates to a substantially perpendicular position. Once the door 22 reaches this position, the pin 74 can be at the level of the opening of the open slot 78, such that when the pin 74 is positioned over the open slot 78, the pin 74 can fall into the open slot 78 thereby resetting the latching mechanism 70. Further details regarding examples of latching mechanism 70 are included in U.S. Pat. No. 6,692,187 entitled "Flood Gate For Door," which is incorporated herein by reference.

In order to prevent air from passing through a flood vent, the flood vent typically includes a door that may substantially prevent the air from entering and/or exiting the structure. This may be important in cold weather as it may prevent heated air from escaping the structure (such as a building) and/or may prevent cold air from entering the structure. Conversely, this may also be important in warm weather as it may prevent cooled air from escaping the structure and/or may prevent hot air from entering the structure. Unfortunately, using a typical door to prevent air from entering and/or exiting the structure may be deficient. For example, even when the typical door is closed, the door may include gaps between the outer perimeter of the door and the inner perimeter of the frame. These gaps may allow at least a small portion of air to enter and/or exit the structure. Contrary to this, FIGS. 3-4 illustrate examples of insulation that may provide one or more advantages.

FIGS. 3*a*, 3*b*, 3*c*, and 3*d* illustrate the flood vent of FIGS. 1-2 having example insulation. As illustrated, insulation 30 may be positioned on the inner perimeter of the frame 10. For example, insulation 30 may be positioned on one or more (or all) of the top interior edge 13*a* of the frame 10, the bottom interior edge 13*b* of the frame 10, the side interior edge 13*c* of the frame 10, or the side interior edge 13*d* of the frame 10. In particular embodiments, such a positioning of the insulation 30 may further prevent air from entering and/or exiting the structure through the flood vent 8.

Insulation 30 may include any material configured to at least partially prevent air from passing through insulation 30. For example, insulation 30 may be rubber, plastic, a polymer, a foam, a metal (such as aluminum, stainless steel, spring steel, a galvanized material, any other metal, or any combination of the preceding), any other insulating material, any other material configured to at least partially prevent air from passing through insulation 30, or any combination of the preceding. In one embodiment, insulation 30 may be a foam insulation, such as polyurethane, polyisocyanurate, polystyrene, icynene, air krete, teflon (PTFE), polyester, synthetic rubber, any other foam insulation, or any combination of the preceding. In another embodiment, insulation 30 may be a rubber or polymer liner (or flap), such as butyl, natural rubber, nitrile, ethylene propylene, polyurethane, silicone, any other rubber or polymer liner (or flap), or any combination of the preceding. An example of insulation 30 as a rubber or polymer liner (or flap) is illustrated below in FIG. 3*d*. In a further embodiment, insulation 30 may be a felt, such as polycarbonate fiber. In particular embodiments the felt insulation 30 may have a plastic material between two portions of felt.

As is discussed above, insulation 30 may be positioned on the inner perimeter of the frame 10. The insulation 30 may be positioned on any location of the inner perimeter of the frame 10. For example, the insulation 30 may positioned on the inner perimeter of the frame 10 in a location that is exterior to the door 22 (e.g., as illustrated in FIG. 3*b*, insulation 30 may be positioned to the left of the center-line axis of door 22). In such an example, the insulation 30 may be positioned at a location in-between the railing 12 of the frame 10 and the center-line axis of the door 22. In particular embodiments, such a positioning may prevent (or substantially prevent) at least a portion of the air outside of the structure 17 from even reaching the door 22 when attempting to enter the structure 17. In particular embodiments, such a positioning may also prevent (or substantially prevent) at least a portion of the air inside of the structure 17 from exiting the flood vent 8 even though it may have passed through a gap between the door 22 and the frame 10. As another example, the insulation 30 may positioned on the inner perimeter of the frame 10 in a location that is interior to the door 22 (e.g., as illustrated in FIG. 3*b*, insulation 30 may be positioned to the right of the center-line axis of door 22). In such an example, the insulation 30 may be positioned at a location in-between the center-line axis of the door 22 and the interior of the structure 17. In particular embodiments, such a positioning may prevent (or substantially prevent) at least a portion of the air inside of the structure 17 from even reaching the door 22 when attempting to exit the structure 17. In particular embodiments, such a positioning may also prevent (or substantially prevent) at least a portion of the air outside of the structure 17 from entering the structure 17 even though it may have passed through a gap between the door 22 and the frame 10. As a another example, the insulation 30 may be positioned at both a location that is exterior to the door 22 and also a location that is interior to the door 22, as is illustrated in FIG. 3*b*. As a further example, the insulation 30 may be positioned at a location that is in line with the center-line axis of the door 22 (e.g., as illustrated in FIG. 3*b*, insulation 30 may be positioned directly under, above, and/or to the sides of the door 22).

Insulation 30 may be positioned on any combination of the interior edges 13 of the frame 10. For example, insulation 30 may be positioned on the top interior edge 13*a* of the frame 10, the bottom interior edge 13*b* of the frame 10, the side interior edge 13*c* of the frame 10, the side interior edge 13*d* of the frame 10, or any combination of the preceding. Furthermore, insulation 30 may extend over any length of each edge 13 on which it is positioned. For example, insulation 30 may extend over all (or a portion) of the length of one or more of the top interior edge 13*a* of the frame 10, the bottom interior edge 13*b* of the frame 10, the side interior edge 13*c* of the frame 10, or the side interior edge 13*d* of the frame 10. As is illustrated, insulation 30 may extend over the entire length of each of the top interior edge 13*a* of the frame 10, the bottom interior edge 13*b* of the frame 10, the side interior edge 13*c* of the frame 10, and the side interior edge 13*d* of the frame 10. As such, insulation 30 may extend of the entire length of the inner perimeter of the frame 10.

Insulation 30 may extend over the same length (or the same percentage of length) of each edge 13 on which it is positioned. For example, in an embodiment where insulation 30 is positioned on all interior edges 13 of the frame 10, insulation 30 may extend over the entire length of the top interior edge 13*a* of the frame 10, the entire length of the bottom interior edge 13*b*, the entire length of the side interior edge 13*c* of the frame 10, and the entire length of the side interior edge 13*d* of the frame 10. Alternatively, insulation 30 may extend over different lengths (or different percentages of length) of each edge 13 on which it is positioned. For example, in an embodiment where insulation 30 is positioned on all interior edges 13 of the frame 10, insulation 30 may extend over the entire length of the top interior edge 13*a* of the frame 10, the entire length of the bottom interior edge 13*b*, only a portion of the length of the side interior edge 13*c* of the frame 10, and only a portion of the length of the side interior edge 13*d* of the frame 10. In particular embodiments, insulation 30 may include one or more openings (such as cut outs, gaps, or deviations) that my prevent insulation 30 from extending over an entire length of an edge 13 on which it is positioned. For example, insulation 30 positioned on side interior edges 13*c* and 13*d* of the frame 10 may have one or more openings that may allow pin 74 (extending from one or more floats) and/or door pins 86 to pass through insulation 30 when the door is opened and/or installed. In such an example, insulation 30 may extend substantially over the entire length of side interior edges 13*c* and/or 13*d*. Furthermore, in such an example, insulation 30 may extend substantially over the entire length of the inner perimeter of the frame 10.

Figure 3C:
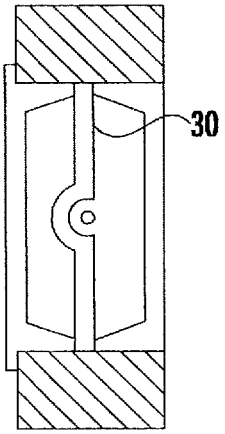
Figure 3D:
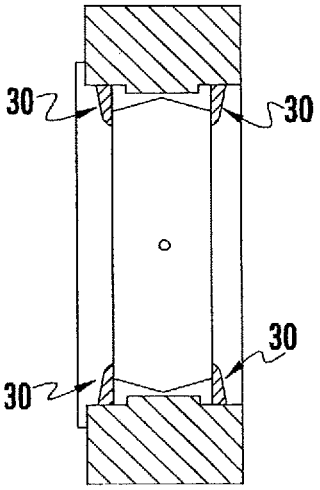

In particular embodiments, the one or more openings in insulation 30 may not prevent insulation 30 from extending over an entire length of an edge 13 on which it is positioned. For example, the one or more openings in insulation 30 may only partially reduce the height of the insulation 30 in the area of the opening. This reduction in height may allow the pins 74 and/or door pins 86 (for example) to pass through insulation 30, but may not entirely eliminate the insulation 30 in the area of the opening. As such, the insulation 30 may still extend over an entire length of the edge 13, even though the insulation 30 may include the one or more openings. As another example, as is shown in FIG. 3*c*, the one or more openings may be a deviation in the positioning of the insulation 30, which may provide an area for the pins 74 and/or door pins 86 to pass through the insulation 30 (and/or move within the insulation 30). In such an example, the deviation may form a shape in the insulation 30 (such as a semi-circle, half of a rectangle, half of a square, any other shape, or any combination of the preceding) that provides an area for the pins 74 and/or door pins 86 to pass through insulation 30 (and/or move within insulation 30). As such, the insulation 30 may still extend over an entire length of the edge 13, even though the insulation 30 may include the openings.

Insulation 30 may have any height 32. For example, insulation 30 may have a height 32 of 0.25", 0.375", 0.4", 0.5", or any other height 32. Insulation 30 may have any thickness 34. For example insulation 30 may have a thickness 34 of 0.024", 0.048", 0.1" 0.25", 0.375", 0.4", 0.5", or any other thickness 34. Insulation 30 may have any length 36. For example, as is discussed above, insulation 30 may extend over all (or a portion) of the length of an edge 13 on which insulation 30 is positioned. As such, insulation 30 may have a length 36 that allows insulation 30 to extend over all (or a portion) of the length of the edge 13 on which insulation 30 is positioned. The height 32, thickness 34, and/or length 36 may be the same (or substantially the same) throughout the insulation 30. Alternatively, the height 32, thickness 34, and/or length 36 may be different at portions of insulation 30. For example, insulation 30 positioned on the top interior edge 13*a* may have a different height 32, thickness 34, and/or length 36 than the insulation 30 positioned on the side interior edge 13*c*, or any of the other interior edges 13.

Insulation 30 may have any shape. For example, insulation 30 may have a rectangular cross-section, a square cross-section, an oval cross-section, a triangular cross-section, an irregular cross-section, or any combination of the preceding. In particular embodiments, the shape of insulation 30 may be based on the shape of door 22. For example, as is illustrated in FIG. 3*b*, insulation 30 positioned on the top interior edge 13*a* and/or the bottom interior edge 13*b* may have angled top portions 38 that conform to the angled portions 25 of top edge 24*a* and/or bottom edge 24*b* of the door 22. In particular embodiments, the angled top portions 38 may be parallel to the angled portions 25 of the door 22. As such, the door may more easily open and close without contacting (or substantially contacting) insulation 30. In particular embodiments, the angled top portions 38 of insulation 30 may be within 10 degrees of the angle of the angled portions 25 of the door 22, thereby causing the angled top portions 38 of insulation 30 to be substantially parallel to the angle of the angled portions 25 of the door 22. This may, in particular embodiments, also allow the door 22 to more easily open and close without contacting (or substantially contacting) insulation 30. The shape of insulation 30 may be the same (or substantially the same) throughout the insulation 30. Alternatively, the shape of insulation 30 may be different at portions of insulation 30. For example, insulation 30 positioned on the top interior edge 13*a* may have a different shape (e.g., a shape with angles that conform to the angle of angled portions 25 of the door 22) than the insulation 30 positioned on the side interior edge 13*c* (e.g., a rectangle cross section), or any of the other interior edges 13.

Insulation 30 may be made up of one or more pieces of insulation 30. As a first example, insulation 30 may be made up of a single piece of insulation 30 that extends over all (or a portion of) the length of the inner perimeter of frame 10. In such an example, if insulation 30 is positioned on the inner perimeter of the frame 10 in a location that is exterior (or interior) to the door 22, a single piece of insulation 30 may be positioned on the inner perimeter of the frame 10 in the location that is exterior (or interior) to the door 22. Additionally, if insulation 30 is positioned on the inner perimeter of the frame 10 in both a location that is exterior to the door 22 and a location that is interior to the door 22, a first single piece of insulation 30 may be positioned on the inner perimeter of the frame 10 in the location that is exterior to the door 22, and a second single piece of insulation 30 may be positioned on the inner perimeter of the frame 10 in the location that is interior to the door 22. Furthermore, the single piece of insulation 30 (or each single piece of insulation 30) may extend over all (or a portion of) the length of the inner perimeter of frame 10.

As a second example, insulation 30 may be made up of two or more pieces of insulation 30. In such an example, insulation 30 may include a first piece of insulation 30 that is positioned on the top interior edge 13*a* of the frame 10, a second piece of insulation 30 that is positioned on the bottom interior edge 13*b* of the frame 10, a third piece of insulation 30 that is positioned on the side interior edge 13*c* of the frame 10, and a fourth piece of insulation 30 that is positioned on the side interior edge 13*d* of the frame 10. Furthermore, these two or more pieces of insulation 30 may collectively extend over all (or a portion of) the length of the inner perimeter of frame 10. Additionally, as is discussed above, these two or more pieces may be positioned on the inner perimeter of the frame 10 in a location that is exterior to the door 22, in a location that is interior to the door 22, in both a location that is exterior to the door 22 and a location that is interior to the door 22, or in a location that is in line with a center-line axis of the door 22.

Insulation 30 may be positioned on the inner perimeter of the frame 10 in any manner. As an example, each piece of insulation 30 may be attached to the inner perimeter of the frame 10 using an adhesive (such as Lexel® clear adhesive). The adhesive may be applied to the frame 10 and/or the piece of the insulation 30 prior to the insulation 30 being positioned on the inner perimeter of the frame 10. As a further example, each piece of insulation 30 may be sprayed on the inner perimeter of the frame 10, mechanically attached to the inner perimeter of the frame 10, or positioned on the inner perimeter of the frame 10 in any other manner.

Figure 4A:
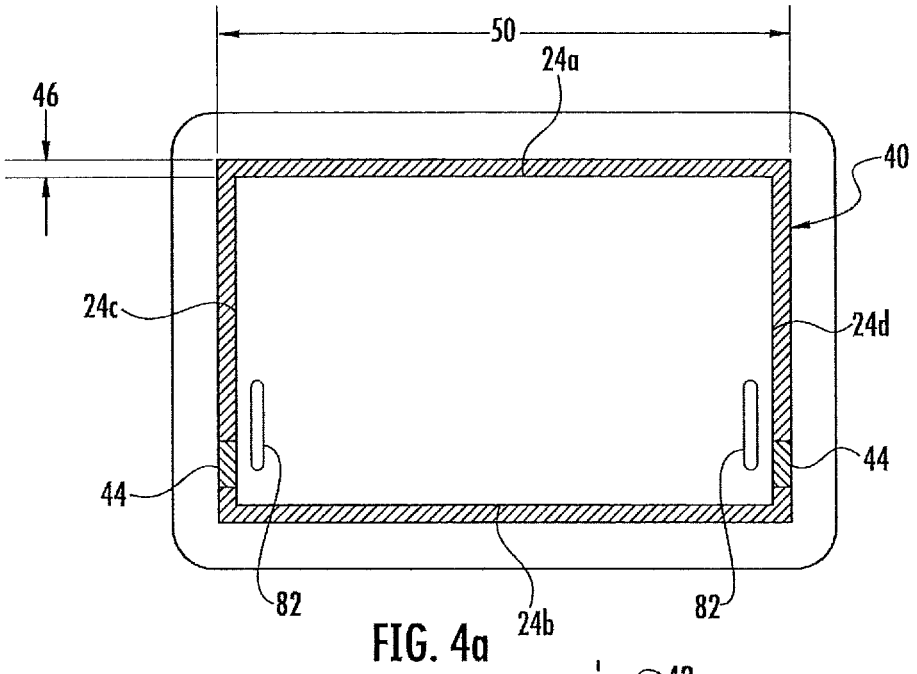
FIGS. 4*a* and 4*b* illustrate the flood vent of FIGS. 1-2 having another example insulation.
Figure 4B:
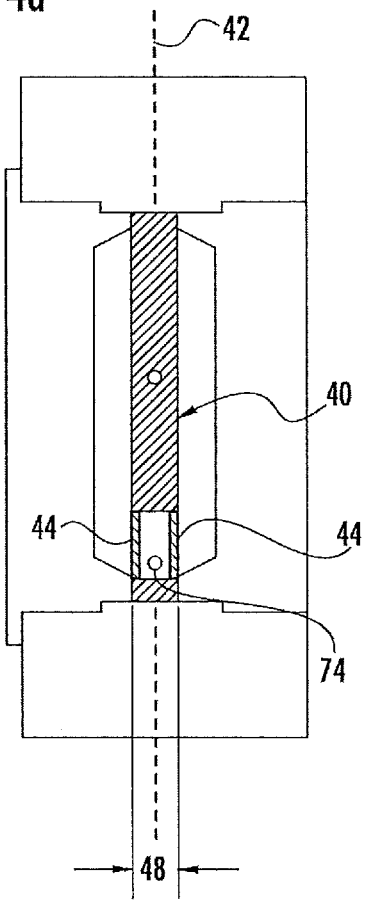

FIGS. 4*a* and 4*b* illustrate the flood vent of FIGS. 1-2 having another example insulation. As illustrated, insulation 40 may be positioned on the outer perimeter of the door 22. For example, insulation 40 may be positioned on one or more (or all) of the top edge 24*a* of the door 22, the bottom edge 24*b* of the door 22, the side edge 24*c* of the door 22, or the side edge 24*d* of the door 22. In particular embodiments, such a positioning of the insulation 40 may further prevent air from entering and/or exiting the structure through the flood vent 8.

Insulation 40 may include any material configured to at least partially prevent air from passing through insulation 40. For example, insulation 40 may be rubber, plastic, a polymer, a foam, a metal (such as aluminum, stainless steel, spring steel, a galvanized material, any other metal, or any combination of the preceding), any other insulating material, any other material configured to at least partially prevent air from passing through insulation 40, or any combination of the preceding. In one embodiment, insulation 40 may be a foam insulation, such as polyurethane, polyisocyanurate, polystyrene, icynene, air krete, teflon (PTFE), polyester, synthetic rubber, any other foam insulation, or any combination of the preceding. In another embodiment, insulation 40 may be a rubber or polymer liner (or flap), such as butyl, natural rubber, nitrile, ethylene propylene, polyurethane, silicone, any other rubber or polymer liner (or flap), or any combination of the preceding. In a further embodiment, insulation 40 may be a felt, such as polycarbonate fiber. In particular embodiments the felt insulation 40 may have a plastic material between two portions of felt.

As is discussed above, insulation 40 may be positioned on the outer perimeter of the door 22. The insulation 40 may be positioned on any location of the outer perimeter of the door 22. For example, the insulation 40 may positioned on a center-line axis 42 of the door 22 that defines the center of the door 22, such as is illustrated in FIG. 4*b*. As another example, the insulation 40 may be positioned exterior to the center-line axis 42 of the door 22 (e.g., in a location positioned to the left of the center-line axis 42 of FIG. 4*b*). As a further example, the insulation 40 may be positioned interior to the center-line axis 42 of the door 22 (e.g., in a location positioned to the right of the center-line axis 42 of FIG. 4*b*).

Insulation 40 may be positioned on any combination of the edges 24 of the door 22. For example, insulation 40 may be positioned on the top edge 24*a* of the door 22, the bottom edge 24*b* of the door 22, the side edge 24*c* of the door 22, the side edge 24*d* of the door 22, or any combination of the preceding. Furthermore, insulation 40 may extend over any length of each edge 24 on which it is positioned. For example, insulation 40 may extend over all (or a portion) of the length of one or more of the top edge 24*a* of the door 22, the bottom edge 24*b* of the door 22, the side edge 24*c* of the door 22, or the side edge 24*d* of the door 22. In particular embodiments, insulation 40 may extend over the entire length of each of top edge 24*a* of the door 22, the bottom edge 24*b* of the door 22, the side edge 24*c* of the door 22, and the side edge 24*d* of the door 22. As such, insulation 40 may extend of the entire length of the outer perimeter of the door 22.

Insulation 40 may extend over the same length (or the same percentage of length) of each edge 24 on which it is positioned. For example, in an embodiment where insulation 40 is positioned on all edges 24 of the door 22, insulation 40 may extend over the entire length of the top edge 24*a* of the door 22, the entire length of the bottom edge 24*b* of the door 22, the entire length of the side edge 24*c* of the door 22, and the entire length of the side edge 24*d* of the door 22. Alternatively, insulation 30 may extend over different lengths (or different percentages of length) of each edge 24 on which it is positioned. For example, in an embodiment where insulation 40 is positioned on all edges 24 of the door 22, insulation 40 may extend over the entire length of the top edge 24*a* of the door 22, the entire length of the bottom edge 24*b* of the door 22, only a portion of the length of the side edge 24*c* of the door 22, and only a portion of the length of the side edge 24*d* of the door 22. In particular embodiments, insulation 40 may include one or more openings (such as cut outs, gaps, or deviations) that my prevent insulation 40 from extending over an entire length of an edge 24 of the door 22 on which it is positioned. For example, insulation 40 positioned on side edges 24*c* and 24*d* of the door 22 may have one or more openings that may allow pin 74 (extending from one or more floats) to be lifted and/or lowered by the height or flow of fluid through fluid openings 82 in the door 22, and/or may allow the door pins 86 to extend through the insulation 40 into the frame 10. In such an example, insulation 40 may extend substantially over the entire length of side edges 24*c* and/or 24*d*. Furthermore, in such an example, insulation 40 may extend substantially over the entire length of the perimeter of the door 22. In particular embodiments, as is illustrated in FIGS. 4*a* and 4*b*, the openings may be covered by one or more flaps 44. In such embodiments, the flaps 44 may at least partially prevent air from passing through the openings in insulation 40.

In particular embodiments, the one or more openings in insulation 40 may not prevent insulation 40 from extending over an entire length of an edge 24 on which it is positioned. For example, the one or more openings in insulation 40 may only be made in an interior portion of the thickness 48 of the insulation 40, but may not be made in the exterior portions of the thickness 48 of the insulation 40, thereby creating a pocket that may be free of insulation 40. This opening in the thickness 48 of the insulation 40 may allow pin 74 (extending from one or more floats) to be lifted and/or lowered by the height or flow of fluid through fluid openings 82 in the door 22 and/or may allow the door pins 86 to extend through the insulation 40 into the frame 10, but may not eliminate the exterior portions of the thickness of the insulation 40. As such, the insulation 40 may still extend over an entire length of the edge 24, even though the insulation 40 may include the one or more openings. As another example, as is discussed above with regard to FIG. 3*c*, an opening may be a deviation in the positioning of the insulation 40, which may provide an area that may allow the pins 74 to move within insulation 40, and/or allow the door pins 86 to extend through the insulation 40 into the frame 10. In such an example, the deviation may form a shape in the insulation 40 (such as a semi-circle, half of a rectangle, half of a square, any other shape, or any combination of the preceding) that provides an area that may allow the pins 74 to move within insulation 40, and/or allow the door pins 86 to extend through the insulation 40 into the frame 10. As such, the insulation 40 may still extend over an entire length of the edge 24, even though the insulation 40 may include the openings.

Insulation 40 may have any height 46. For example, insulation 40 may have a height 46 of 0.25", 0.375", 0.4", 0.5", or any other height 46. In particular embodiments, the height 46 of insulation 40 may cause the insulation 40 attached to the door 22 to be flush against the inner perimeter of the frame 10. Insulation 40 may have any thickness 48. For example insulation 40 may have a thickness 48 of 0.024", 0.048", 0.1" 0.25", 0.375", 0.4", 0.5", or any other thickness 48. Insulation 40 may have any length 50. For example, as is discussed above, insulation 40 may extend over all (or a portion) of the length of an edge 24 on which insulation 40 is positioned. As such, insulation 40 may have a length that allows insulation 40 to extend over all (or a portion) of the length of the edge 24 on which insulation 40 is positioned. The height 46, thickness 48, and/or length 50 may be the same (or substantially the same) throughout the insulation 40. Alternatively, the height 46, thickness 48, and/or length 50 may different at portions of insulation 40. For example, insulation 40 positioned on the top edge 24*a* may have a different height 46, thickness 48, and/or length 50 than the insulation 40 positioned on the side edge 24*c*, or any of the other interior edges 24.

Insulation 40 may have any shape. For example, insulation may have a rectangular cross-section, a square cross-section, an oval cross-section, a triangular cross-section, an irregular cross-section, or any combination of the preceding. The shape of insulation 40 may be the same (or substantially the same) throughout the insulation 40. Alternatively, the shape of insulation 40 may be different at portions of insulation 40. For example, insulation 40 positioned on the top edge 24*a* may have a different shape than the insulation 40 positioned on the side edge 24*c*, or any of the other edges 24.

Insulation 40 may be made up of one or more pieces of insulation 40. As a first example, insulation 40 may be made up of a single piece of insulation 40 that extends over all (or a portion of) the length of the perimeter of door 22. In such an example, a single piece of insulation 40 extending over all (or substantially all) of the perimeter of door 22 may be positioned on each of the edges 24 of the door 22. As a second example, insulation 40 may be made up of two or more pieces of insulation 40. In such an example, insulation 40 may include a first piece of insulation 40 that is positioned on the top edge 24*a* of the door 22, a second piece of insulation 40 that is positioned on the bottom edge 24*b* of the door 22, a third piece of insulation 40 that is positioned on the side edge 24*c* of the door 22, and a fourth piece of insulation 40 that is positioned on the side edge 24*d* of the door 22. Furthermore, these two or more pieces of insulation 40 may collectively extend over all (or a portion of) the length of the perimeter of door 22.

Insulation 40 may be positioned on the perimeter of the door 22 in any manner. As an example, each piece of insulation 40 may be attached to the perimeter of the door 22 using an adhesive (such as Lexel® clear adhesive). The adhesive may be applied to the door 22 and/or the piece of the insulation 40 prior to the insulation 40 being positioned on the perimeter of the door 22. As a further example, each piece of insulation 40 may be sprayed on to the perimeter of the door 22, mechanically attached to the perimeter of the frame 22, or positioned on the perimeter of the door 22 in any other manner.

As is discussed above, one or more flood vents may typically be installed into an opening in a structure (such as a building) in order to provide for equalization of interior and exterior hydrostatic forces caused by flooding fluids, such as water. These flood vents are typically installed on the exterior of the structure (such as the exterior of a building). The opening in the structure, however, may extend from the exterior of the structure to the interior of the structure (such as the interior of a building). This may be problematic because it may result in a substantial opening in the interior of the structure that may not be aesthetically pleasing. Furthermore, such an opening may allow air to enter and/or exit the structure, which can increase the cost to heat and/or cool the structure. To prevent these problems, the opening in the interior of the structure has typically been sealed with a removable panel. Unfortunately, this may cause additional problems. For example, every time there is a possibility of flooding, a person must remove the removable panel. If the removable panel is not removed, the flood vent may not operate properly because the removable panel on the interior of the structure may prevent water from entering and/or exiting the structure (regardless of the flood vent on the exterior of the structure). Contrary to this, FIGS. 5-7 illustrate examples of one or more interior flood vents that may provide one or more advantages.

Figure 5A:
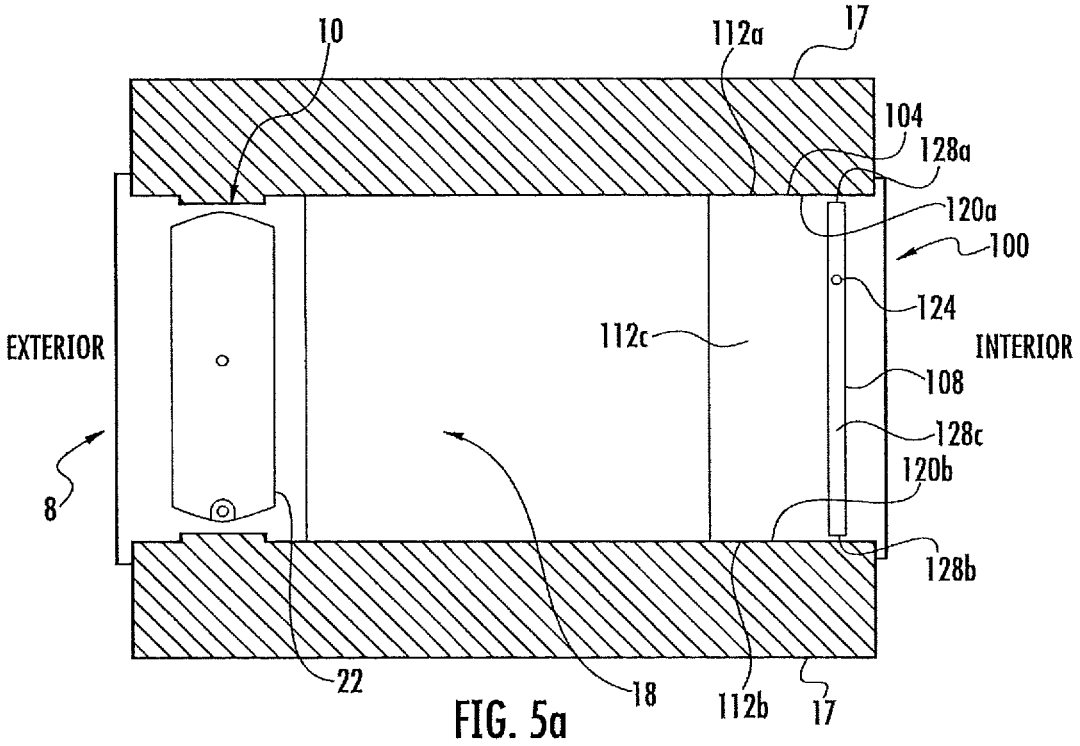
FIGS. 5*a* and 5*b* illustrate an example of a flood vent and an interior flood vent installed in an opening in a structure.
Figure 5B:
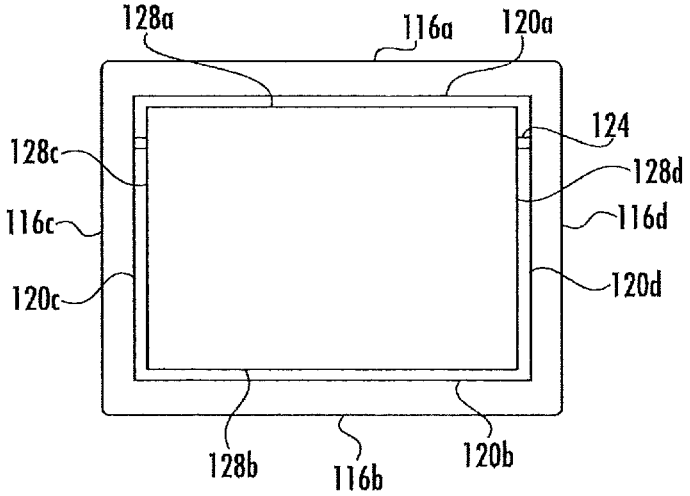

FIGS. 5*a* and 5*b* illustrate an example of a flood vent and an interior flood vent installed in an opening in a structure. As illustrated in FIG. 5*a*, a structure 17 (such as a building, a wall, a foundation, a basement, a garage, a foyer, an entry, any structure located below base flood plain levels, any other structure, or any combination of the preceding) may include an opening 18. A flood vent 8 may be inserted (or otherwise installed) into the opening 18 in the structure 17. Furthermore, this insertion (or installation) may cause the flood vent 8 to be installed on the exterior of the structure 17, in particular embodiments. Flood vent 8 includes a frame 10 (which may form a first portion of the fluid passageway through the opening 18 in the structure 17) and a door 22. Details regarding the flood vent 8 are described above with regard to FIGS. 1-2. FIG. 5*a* further includes an interior flood vent 100. The interior flood vent 100 may also be inserted (or otherwise installed) into the opening 18 in the structure 17. Furthermore, this insertion (or installation) may cause the interior flood vent 100 to be installed on the interior of the structure 17, in particular embodiments.

As illustrated, the interior flood vent 100 includes a frame 104 and a door 108. The frame 104 may form a second portion of the fluid passageway through the opening 18 in the structure 17. The frame 104 includes a top edge 112*a*, a bottom edge 112*b*, and two side edges 112*c* and 112*d* (not shown). The edges 112 may define an outer perimeter of the frame 104. The frame 104 further includes a top rail 116*a*, a bottom rail 116*b*, and side rails 116*c* and 116*d*. When the interior flood vent 100 is inserted (or otherwise installed) in the opening 18 in the structure 17, the edges 112 of the frame 104 may be positioned (entirely or partially) within the opening 18 of the structure 17, and the rails 116 may be positioned (entirely or partially) outside the opening 18 of the structure 17 (e.g., on the interior side of the structure 17). The frame 104 also includes a top interior edge 120*a*, a bottom interior edge 120*b*, and two side interior edges 120*c* and 120*d*. The interior edges 120 of the frame 104 may define an inner perimeter of the frame 104. Furthermore, although the interior flood vent 100 is illustrated as including a single frame 104 and a single door 108, the interior flood vent 100 may include multiple frames 104 and/or multiple doors 108. For example, the interior flood vent 100 may include two frames 104 (or two or more frames 104) stacked on top of each other (and coupled together), along with one or more doors 108 attached to each frame 104. As another example, the interior flood vent 100 may include two frames 104 (or two or more frames 104) positioned horizontally next to each other (and coupled together), along with one or more doors 108 attached to each frame 104. As a further example, the interior flood vent 100 may include two frames 104 (or two or more frames 104) stacked on top of each other and two frames 104 (or two or more frames 104) positioned horizontally next to each other (and these four or more frames 104 may be coupled together), along with one or more doors 108 attached to each frame 104. In particular embodiments, interior flood vent 100 may have the same number and configuration of frames 104 (and doors 108) as flood vent 8. For example, if flood vent 8 include two frames 10 (or two or more frames 10) positioned horizontally next to each other (and coupled together), along with one or more doors 22 attached to each frame 10, interior flood vent 100 may also include two frames 104 (or two or more frames 104) positioned horizontally next to each other (and coupled together), along with one or more doors 108 attached to each frame 104.

The frame 104 may have any shape. For example, the frame 104 may be rectangular-shaped. The frame 104 may also have any dimensions. For example, the top and bottom edges 112*a* and 112*b* may be approximately 16" long, and the side edges 112*c* and 112*d* may be approximately 8" long, thereby forming an 8"×16" rectangular outer perimeter. Furthermore, the top and bottom rails 116*a* and 116*b* may be approximately $17\frac{11}{16}$" long, and the side rails 116*c* and 116*d* may be approximately $9\frac{11}{16}$" long. Additionally, when two or more frames 104 are coupled together (as is discussed above), the interior flood vent 104 may have an outer perimeter of, for example, approximately 16"×16", 8"×32", 16"×32", or any other dimensions. In particular embodiments, the frame 104 may have the same shape and/or dimensions as the frame 10 of the flood vent 8. The frame 104 may be formed of any material. For example, the frame 104 may be formed of a corrosion resistant material, such as stainless steel, spring steel, plastic, a polymer, any other corrosion resistant material, or any combination of the preceding.

The interior flood vent 100 further includes a door 108 attached to the frame 104 (or multiple doors 108 attached to multiple frames 104). The door 108 may be pivotally mounted to the frame 104, thereby allowing the door 108 to pivot relative to the frame 104. The door 108 may be mounted to the frame 104 in any manner that allows the door 108 to pivot relative to the frame 104. For example, the door 108 may include one or more door pins 124 that extend from the door 108. In such an example, the door pins 124 may be configured to be received within door slots (an example of which is shown in FIG. 2*b*) which may be disposed within the frame 104. The door slots may be ?-shaped, an example of which is seen in FIG. 2*b*. As another example, the door slots may be T-shaped. Such configurations may allow the door pins 124 to rise in the door slots, thereby permitting the door 108 to rise in response to flooding. Furthermore, such configurations may prevent the door 108 from being easily removed during flooding conditions.

The door 108 may be a single solid panel (as is illustrated in FIG. 5*a*), or may include solid panels disposed on opposing faces of the door 108. The solid panel(s) may prevent (or substantially prevent) air from passing through the door 108, as well as prevent (or substantially prevent) objects from passing through the door 108. Additionally, the solid panel(s) may make the interior flood panel 100 more aesthetically pleasing from the interior of the structure 17, in particular embodiments. The door 108 further includes a top edge 128*a*, a bottom edge 128*b*, and two side edges 128*c* and 128*d*. The edges 128 of the door 108 may define an outer perimeter of the door 108. Furthermore, the edges 128 of the door 108 may have any shape. As an example, the edges 128 of the door 108 may be flat, curved, angled, or any combination of the preceding. Additionally, the door 108 may include one or more of the features (or all of the features) of door 22 described above with regard to FIGS. 1-2.

The interior flood vent 100 may provide an entry point and/or exit point in the structure 17 for flooding fluids, such as water. In order to do so, the door 108 may open and close by pivoting relative to the frame 104. The door 108 may open and close without any type of latching mechanism, in particular embodiments. For example, the door 108 may open when the flow of fluids (or the pressure caused by the flow of fluids) is strong enough to pivot the door 108 to open. In other embodiments, the door 108 may include a latching mechanism, such as latching mechanism 70 discussed above with regard to FIGS. 1-2.

The flood vent 8 and the interior flood vent 100 may further include a sleeve that is positioned in-between the flood vent 8 and the interior flood vent 100. The sleeve may connect to the flood vent 8 at a first end of the sleeve, extend through the opening 18 in the structure 17 to the interior flood vent 100, and connect to the interior flood vent 100 at a second end of the sleeve. The sleeve may form a third portion of the fluid passageway through the opening 18 in the structure 17. For example, fluid such as water may enter the opening 18 in the structure 17 through flood vent 8, flow through the sleeve, and exit the opening 18 into the interior of the structure 17 (or vice versa). The sleeve may have any shape. For example, the sleeve may be a hollow rectangular sleeve. The sleeve may have any dimensions. For example, the sleeve may be sized to fit entirely within the opening 18, connecting the flood vent 8 to the interior flood vent 100. The sleeve may be made of any material. For example, the sleeve may be formed of a corrosion resistant material, such as stainless steel, spring steel, plastic, a polymer, any other corrosion resistant material, or any combination of the preceding.

Figure 6A:
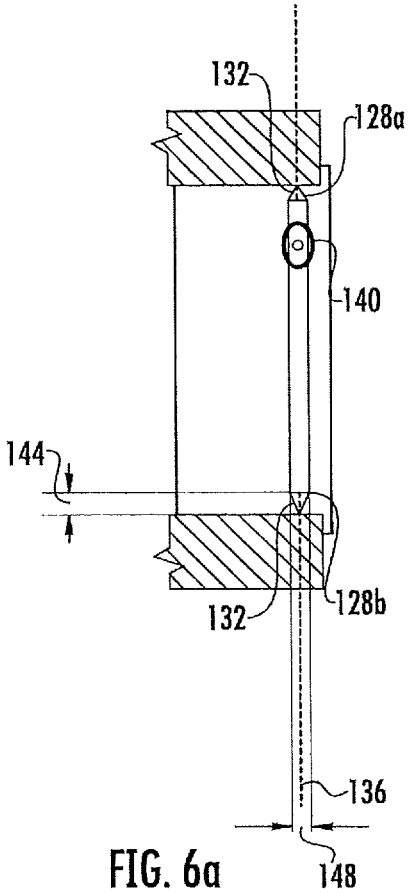
FIGS. 6*a* and 6*b* illustrate the interior flood vent of FIGS. 5*a*-5*b* with an example door having insulation.
Figure 6B:
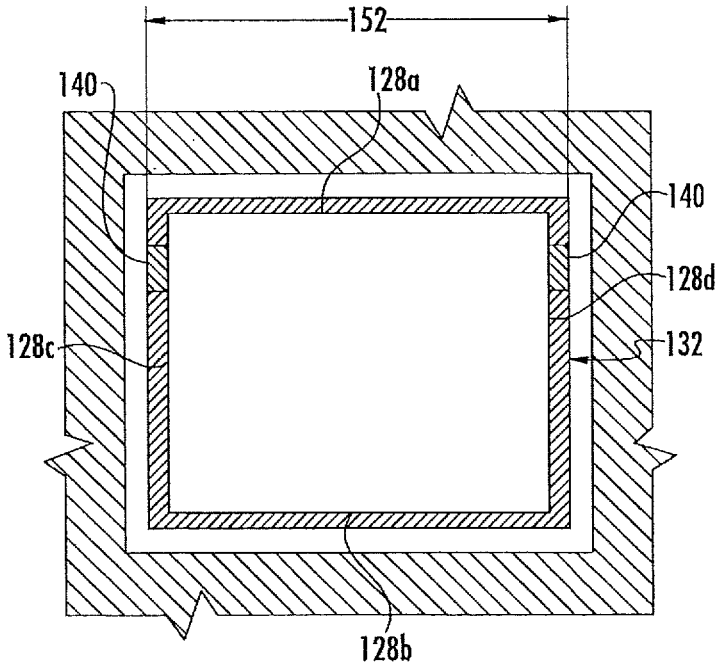

FIGS. 6*a* and 6*b* illustrate the interior flood vent of FIGS. 5*a*-5*b* with an example door having insulation. As illustrated, insulation 132 may be positioned on the outer perimeter of the door 108. For example, insulation 132 may be positioned on one or more (or all) of the top edge 128*a* of the door 108, the bottom edge 128*b* of the door 108, the side edge 128*c* of the door 108, or the side edge 128*d* of the door 108. In particular embodiments, such a positioning of the insulation 132 may further prevent air from entering and/or exiting the structure through the interior flood vent 100.

Insulation 132 may include any material configured to at least partially prevent air from passing through insulation 132. For example, insulation 132 may be rubber, plastic, a polymer, a foam, a metal (such as aluminum, stainless steel, spring steel, a galvanized material, any other metal, or any combination of the preceding), any other insulating material, any other material configured to at least partially prevent air from passing through insulation 132, or any combination of the preceding. In one embodiment, insulation 132 may be a foam insulation, such as polyurethane, polyisocyanurate, polystyrene, icynene, air krete, teflon (PTFE), polyester, synthetic rubber, any other foam insulation, or any combination of the preceding. In another embodiment, insulation 132 may be a rubber or polymer liner (or flap), such as butyl, natural rubber, nitrile, ethylene propylene, polyurethane, silicone, any other rubber or polymer liner (or flap), or any combination of the preceding. In a further embodiment, insulation 132 may be a felt, such as polycarbonate fiber. In particular embodiments, the felt insulation 132 may have a plastic material between two portions of felt.

As is discussed above, insulation 132 may be positioned on the outer perimeter of the door 108. The insulation 132 may be positioned on any location of the outer perimeter of the door 108. For example, the insulation 132 may positioned on a center-line axis 136 of the door 108 that defines the center of the door 108, such as is illustrated in FIG. 6*a*. As another example, the insulation 132 may be positioned exterior to the center-line axis 136 of the door 108 (e.g., in a location positioned left of the center-line axis 136 of FIG. 6*a*). As a further example, the insulation 132 may be positioned interior to the center-line axis 136 of the door 108 (e.g., in a location positioned right of the center-line axis 136 of FIG. 6*a*).

Insulation 132 may be positioned on any combination of the edges 128 of the door 108. For example, insulation 132 may be positioned on the top edge 128*a* of the door 108, the bottom edge 128*b* of the door 108, the side edge 128*c* of the door 108, the side edge 128*d* of the door 108, or any combination of the preceding. Furthermore, insulation 132 may extend over any length of each edge 128 on which it is positioned. For example, insulation 132 may extend over all (or a portion) of the length of one or more of the top edge 128*a* of the door 108, the bottom edge 128*b* of the door 108, the side edge 128*c* of the door 108, or the side edge 128*d* of the door 108. In particular embodiments, insulation 132 may extend over the entire length of each of the top edge 128*a* of the door 108, the bottom edge 128*b* of the door 108, the side edge 128*c* of the door 108, and the side edge 128*d* of the door 108. As such, insulation 132 may extend over the entire length of the outer perimeter of the door 108.

Insulation 132 may extend over the same length (or the same percentage of length) of each edge 128 on which it is positioned. For example, in an embodiment where insulation 132 is positioned on all edges 128 of the door 108, insulation 132 may extend over the entire length of the top edge 128*a* of the door 108, the entire length of the bottom edge 128*b* of the door 108, the entire length of the side edge 128*c* of the door 108, and the entire length of the side edge 128*d* of the door 108. Alternatively, insulation 132 may extend over different lengths (or different percentages of length) of each edge 128 on which it is positioned. For example, in an embodiment where insulation 132 is positioned on all edges 128 of the door 108, insulation 132 may extend over the entire length of the top edge 128*a* of the door 108, the entire length of the bottom edge 128*b* of the door 108, only a portion of the length of the side edge 128*c* of the door 108, and only a portion of the length of the side edge 128*d* of the door 108. In particular embodiments, insulation 132 may include one or more openings (such as cut outs, gaps, or deviations) that my prevent insulation 132 from extending over an entire length of an edge 128 of the door 108 on which it is positioned. For example, insulation 132 positioned on side edges 128*c* and 128*d* of the door 108 may have one or more openings that may allow door pin 124 to extend from the door 108 and attach to the frame 104 (thereby allowing the door 108 to pivot). In such an example, insulation 132 may extend substantially over the entire length of side edges 128*c* and/or 128*d*. Furthermore, in such an example, insulation 132 may extend substantially over the entire length of the perimeter of the door 108.

In particular embodiments, as is illustrated in FIGS. 6*a* and 6*b*, the openings may be covered by one or more covers 140. A cover 140 may at least partially prevent air from passing through the openings in insulation 132. The cover 140 may be any material. For example, the cover 140 may be a foam insulation, such as polyurethane, polyisocyanurate, polystyrene, icynene, air krete, teflon (PTFE), polyester, synthetic rubber, any other foam insulation, or any combination of the preceding. The cover 140 may have any shape. Furthermore, the cover 140 may cover all (or a portion) of the circumference of door pin 124. As illustrated, the cover 140 may form a perimeter around (or otherwise encircle) the entire circumference of the door pin 124. As such, the cover 140 may allow door pin 124 to extend from the door 108 and attach to the frame 104, but may also at least partially prevent air from passing through the openings in insulation 132.

In particular embodiments, the one or more openings in insulation 132 may not prevent insulation 132 from extending over an entire length of an edge 128 on which it is positioned. For example, as is discussed above with regard to FIG. 3*c*, the one or more openings may be a deviation in the positioning of the insulation 132, which may provide an area for the door pins 124 to extend from the door 108 and attach to the frame 104. In such an example, the deviation may form a shape in the insulation 132 (such as a semicircle, half of a rectangle, half of a square, any other shape, or any combination of the preceding) that provides an area for the door pin 124 to extend from the door 108 and attach to the frame 104. As such, the insulation 132 may still extend over an entire length of the edge 128, even though the insulation 132 may include the openings.

Insulation 132 may have any height 144. For example, insulation 132 may have a height 144 of 0.25", 0.375", 0.4", 0.5", or any other height 144. In particular embodiments, the height 144 of insulation 132 may cause the insulation 132 attached to the door 108 to be flush against the inner perimeter of the frame 104. Insulation 132 may have any thickness 148. For example insulation 132 may have a thickness 148 of 0.024", 0.048", 0.1" 0.25", 0.375", 0.4", 0.5", or any other thickness 148. Insulation 132 may have any length 152. For example, as is discussed above, insulation 132 may extend over all (or a portion) of the length of an edge 128 on which insulation 132 is positioned. As such, insulation 132 may have a length 152 that allows insulation 132 to extend over all (or a portion) of the length of the edge 128 on which insulation 132 is positioned. The height 144, thickness 148, and/or length 152 may be the same (or substantially the same) throughout the insulation 132. Alternatively, the height 144, thickness 148, and/or length 152 may be different at portions of insulation 132. For example, insulation 132 positioned on the top edge 128*a* may have a different height 144, thickness 148, and/or length 152 than the insulation 132 positioned on the side edge 128*c*, or any of the other edges 128.

Insulation 132 may have any shape. For example, insulation 132 may have a rectangular cross-section, a square cross-section, an oval cross-section, a triangular cross-section, an irregular cross-section, any other cross-section, or any combination of the preceding. The shape of insulation 132 may be the same (or substantially the same) throughout the insulation 132. Alternatively, the shape of insulation 132 may be different at portions of insulation 132. For example, insulation 132 positioned on the top edge 128*a* may have a different shape than the insulation 132 positioned on the side edge 128*c*, or any of the other edges 128.

Insulation 132 may be made up of one or more pieces of insulation 132. As a first example, insulation 132 may be made up of a single piece of insulation 132 that extends over all (or a portion of) the length of the perimeter of door 108. In such an example, a single piece of insulation 132 extending over all (or substantially all) of the perimeter of door 108 may be positioned on each of the edges 128 of the door 108. As a second example, insulation 132 may be made up of two or more pieces of insulation 132. In such an example, insulation 132 may include a first piece of insulation 132 that is positioned on the top edge 128*a* of the door 108, a second piece of insulation 132 that is positioned on the bottom edge 128*b* of the door 108, a third piece of insulation 132 that is positioned on the side edge 128*c* of the door 108, and a fourth piece of insulation 132 that is positioned on the side edge 128*d* of the door 108. Furthermore, the combination of these two or more pieces of insulation 132 may extend over all (or a portion of) the length of the perimeter of door 108.

Insulation 132 may be positioned on the perimeter of the door 108 in any manner. As an example, each piece of insulation 132 may be attached to the perimeter of the door 108 using an adhesive (such as Lexel® clear adhesive). The adhesive may be applied to the door 108 and/or the piece of the insulation 132 prior to the insulation 132 being positioned on the perimeter of the door 108. As a further example, each piece of insulation 132 may be sprayed on to the perimeter of the door 108, mechanically attached to the perimeter of the door 108, or positioned on the perimeter of the door 108 in any other manner.

Figure 7B:
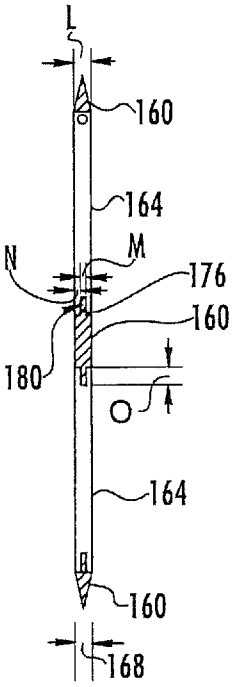
FIGS. 7*a* and 7*b* illustrate another example door for the interior flood vent of FIGS. 5*a*-5*b*.
Figure 7A:
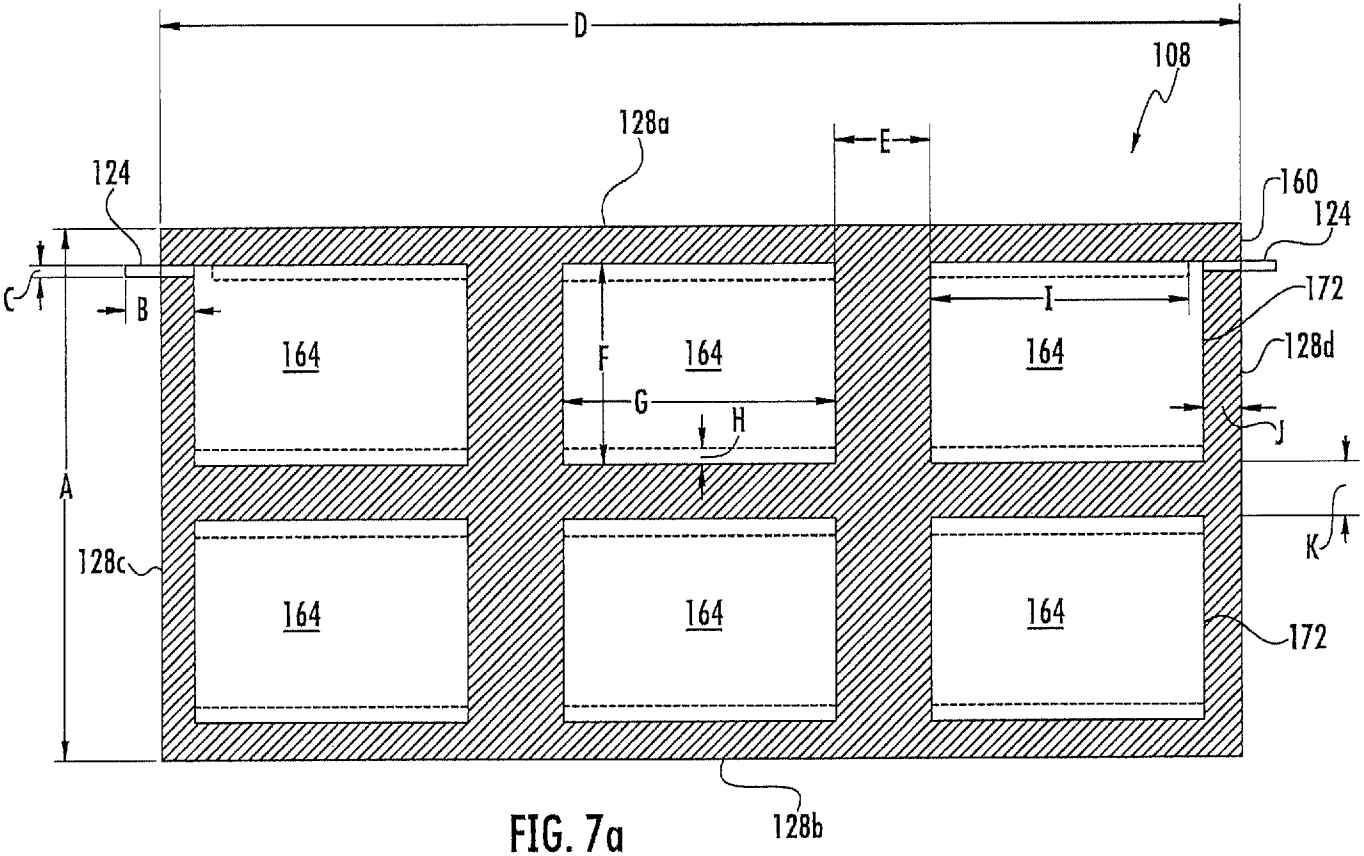

FIGS. 7*a* and 7*b* illustrate another example door for the interior flood vent of FIGS. 5*a*-5*b*. As illustrated, door 108 may be a flexible panel 160 having solid panels 164 positioned within the perimeter of the flexible panel 160. In particular embodiments, the flexible panel 160 may be flush with the inner perimeter of the frame 104. As such, the flexible panel 160 may further prevent air from entering and/or exiting the structure 17 through the interior flood vent 100. In particular embodiments, the flexibility of the flexible panel 160 may allow the seal between the flexible panel 160 and the inner perimeter of the frame 104 to be more easily broken by the flow of fluids. For example, due to the flexibility (or deformability) of the flexible panel 160, the flow of fluids may be able to push open a corner of the flexible panel 160 with less force than would be required to push open an entire typical door. In such an example, the pushing open of the corner of the flexible panel 160 may break the seal between the flexible panel 160 and the inner perimeter of the frame 104, allowing additional portions of the flexible panel 160 to also be opened more easily. As such, the flexible panel 160 may more easily allow fluids to enter and/or exit the structure, which may, in particular embodiments, provide better equalization of interior and exterior hydrostatic forces caused by the flooding fluids.

Flexible panel 160 may include any material configured to at least partially deform, and further configured to at least partially prevent air from passing through flexible panel 160. For example, flexible panel 160 may be rubber, plastic, a polymer, a foam, any other material configured to at least partially deform and further configured to at least partially prevent air from passing through flexible panel 160, or any combination of the preceding. In one embodiment, flexible panel 160 may be a foam insulation panel, such as polyurethane, polyisocyanurate, polystyrene, icynene, air krete, teflon (PTFE), polyester, synthetic rubber, any other foam insulation panel, or any combination of the preceding. In another embodiment, flexible panel 160 may be a rubber or polymer panel (or flap), such as butyl, natural rubber, nitrile, ethylene propylene, polyurethane, silicone, any other rubber or polymer panel, or any combination of the preceding. In a further embodiment, flexible panel 160 may be a felt, such as polycarbonate fiber. In particular embodiments the felt flexible panel 160 may have a plastic material between two portions of felt.

The flexible panel 160 may have any shape. For example, the flexible panel 160 may be rectangular-shaped. The flexible panel 160 may also have any dimensions. For example, the top and bottom edges 128*a* and 128*b* may be approximately 15¾" long, and the side edges 128*c* and 128*d* may be approximately 7¾" long, thereby forming a 7¾"× 15¾" rectangular outer perimeter. In particular embodiments, the flexible panel 160 may have the same (or substantially the same) shape and/or dimensions as the inner perimeter of the frame 104. As such, in particular embodiments, the flexible panel 160 may be flush against the inner perimeter of the frame 104, which may create a seal that may prevent (or substantially prevent) air from entering and/or exiting the structure 17 through the interior flood vent 100. The flexible panel 160 may also have any thickness 168. For example insulation 132 may have a thickness 168 of 0.25", 0.50", 1.0" 1.50", or any other thickness 168. The flexible panel 160 may have any cross-sectional shape. For example, the flexible panel 160 may have a rectangular cross-section, a square cross-section, an oval cross-section, a triangular cross-section, an irregular cross-section, or any combination of the preceding. In particular embodiments, the flexible panel 160 may have a combination of cross-sectional shapes. As an example, as illustrated in FIG. 7*b*, the flexible panel 160 may have a triangular cross-section near edges 128, and may have a rectangular cross-section at the center portions of flexible panel 160.

Flexible panel 160 may be made up of one or more sheets of flexible paneling. For example, flexible panel 160 may be a single sheet of flexible paneling that forms the thickness 168, as is illustrated in FIGS. 7*a* and 7*b*. As another example, flexible panel 160 may be two or more pieces of flexible paneling that are connected together to form the thickness 168 of flexible panel 160. The two or more pieces of flexible paneling may be connected together using any type of connection, such as an adhesive (e.g., Lexel® clear adhesive), a mechanical mechanism (e.g., rivets), lamination, any other type of connection, or any combination of the preceding.

As discussed above, flexible panel 160 may have solid panels 164 positioned within the perimeter of the flexible panel 160. A solid panel 164 may include any material configured to be rigid, and further configured to at least partially prevent air from passing through the solid panel 164. For example, the solid panel 164 may be metal, a hard rubber, plastic, any other material configured to be rigid, and further configured to at least partially prevent air from passing through the solid panel 164, or any combination of the preceding. In particular embodiments, the solid panel 164 may be any material that is more rigid (or less flexible) than flexible panel 160. For example, if the flexible panel 160 is rubber, the solid panel 164 may be metal, plastic, or even a more rigid rubber. In particular embodiments, the solid panels 164 may increase the rigidity (or decrease the flexibility) of the flexible panel 160 so as to create resistance to opening of the flexible panel 160, but still allowing the flexible panel 160 to be flexible. As such, the flexible panel 160 may remain flexible (e.g., thereby allowing the seal between the flexible panel 160 and the frame 104 to be more easily broken), but the flexible panel 160 may still be prevented from being opened by pests or a minor amount of fluids.

Flexible panel 160 may have any number of solid panels 164 positioned within the perimeter of the flexible panel 160. For example, flexible panel 160 may have one solid panel 164, two solid panels 164, three solid panels 164, four solid panels 164, five solid panels 164, six solid panels 164, eight solid panels 164, nine solid panels 164, ten solid panels 164, twelve solid panels 164, or any other number of solid panels 164 positioned within the perimeter of the flexible panel 160. The solid panels 164 may be positioned at any location within the perimeter of the flexible panel 160, and the solid panels 164 may be positioned from each other by any distance. Furthermore, the solid panels 164 may be arranged in any pattern. Examples of patterns may include the following horizontal by vertical solid panel patterns: 1:2, 1:3, 1:4, 1:5, 2:1, 2:2, 2:3, 2:4, 2:5, 3:1, 3:2, 3:3, 3:4, 3:5, 4:1, 4:2, 4:3, 4:4, 4:5, 5:1, 5:2, 5:3, 5:4, 5:5, or any other horizontal by vertical solid panel pattern. As illustrated, flexible panel 160 includes six solid panels 164 positioned in a 3:2 horizontal by vertical solid panel pattern. Additionally, as is discussed above, flexible panel 160 may be two or more pieces of flexible paneling that are connected together to form the thickness 168 of flexible panel 160. In such embodiments, each sheet of flexible paneling may have the same (or a different) number of solid panels 164, pattern of arrangement of solid panels 164, and/or distance between each solid panel 164.

A solid panel 164 may have any shape. For example, the solid panel 164 may be rectangular-shaped, square-shaped, circle-shaped, oval-shaped, irregular-shaped, any other shape, or any combination of the preceding. The solid panel 164 may also have any dimensions. For example, the solid panel 164 may be a 4"×3" rectangle. The solid panel 164 may have the same or different thickness as the flexible panel 160. For example, if the flexible panel 160 has a thickness of 0.25", the solid panels 164 may have a thickness of 0.25", less than 0.25", or greater than 0.25". Each solid panel 164 may have the same shape and/or dimensions, in particular embodiments. Furthermore, one or more (or all) of the solid panels 164 may have different shapes and/or dimensions. A solid panel 164 may further include a door pin 124, as illustrated in FIGS. 7*a*-7*b*. The door pin 124 may extend through a side opening in the flexible panel 160. Furthermore, the door pin 124 may be received within door slots in the frame 104, causing the flexible panel 160 to be pivotally mounted to the frame 104.

A solid panel 164 may be positioned on the flexible panel 160 in any manner. As an example, the flexible panel 160 may include one or more openings 172, as illustrated in FIGS. 7*a* and 7*b*. In particular embodiments, each opening 172 may be dimensioned to fit a solid panel 164 within the opening 172. Furthermore, in particular embodiments, the opening 172 may include a male connector 176 that may be positioned within a corresponding female connector 180 included in the solid panel 164, thereby coupling the solid panel 164 to the flexible panel 160. The male connector 176 may extend over all (or a portion of) the perimeter of the opening 172, while the female connector 180 may also extend over all (or a portion of) the perimeter of the solid panel 164. In particular embodiments, the male connector 176 may be included in the solid panel 164, and the female connector 180 may be included in the opening 172.

Additionally, in particular embodiments, the solid panel 164 and the opening 172 may each include both male connectors 176 and female connectors 180. As further examples, the solid panel 164 may be attached to the flexible panel 160 using an adhesive (such as Lexel® clear adhesive), a mechanical mechanism (such as one or more rivets), any other connection, or any combination of the preceding.

FIGS. 7*a* and 7*b* provide one example of dimensions of a flexible panel 160 having solid panels 164:

A=7.75"±0.005"
B=1.0"±0.005"
C=0.125"±0.005"
D=15.75"±0.005"
E=1.375"±0.005"
F=3.0"±0.005"
G=4.0"±0.005"
H=0.25"±0.005"
I=3.725"±0.005"
J=0.50"±0.005"
K=0.75"±0.005"
L=0.25"±0.005"
M=0.0625"±0.005"
N=0.0938"±0.005"
O=0.25"±0.005"

Although the flexible panel 160 and solid panels 164 have been illustrated as including particular dimensions, the flexible panel 160 and/or solid panels 164 may have any other dimensions. Furthermore, although the flexible panel 160 with solid panels 164 has been described as being used as the door 108 of an interior flood vent 100, in particular embodiments, the flexible panel 160 with solid panels 164 may be used as the door 22 of a flood vent 8, or as both the door 108 of the interior flood vent 100 and the door 22 of the flood vent 8.

As is discussed above, a flood vent may include a latching mechanism that may release the door of the flood vent, allowing the door to open so that flooding fluids, such as water, may enter and/or exit a structure. Typically, such a latching mechanism includes a pin that extends from a float into an open slot on the inner side edge of the frame, locking the door in a horizontal manner. Additionally, such a latching mechanism also typically includes a channel in the inner side edge of the frame that allows the pin to pass through the frame as the door rotates. An example of such a typical latching mechanism is described above with regard to latching mechanism 70, door pin 74, and channel 80 of FIGS. 1-2. In particular embodiments, such a typical latching mechanism may be deficient because it may create a gap in-between the door and the inner side edge of the frame. This gap may allow air to pass through the flood vent, which may provide one or more disadvantages, in particular embodiments. For example, such a gap may allow cold or hot air to exit the structure, or may allow cold or hot air to enter the structure, thereby increasing the cost of heating and/or cooling the structure, in particular embodiments. Furthermore, in particular embodiments, this gap may not be blocked by insulation because such insulation may prevent the float of the latching mechanism from operating properly and/or may prevent the pin connected to the float from passing through the frame as the door rotates. Contrary to this, FIGS. 8*a*, 8*b*, 8*c*, and 8*d* illustrate examples of a vertical latching mechanism that may provide one or more advantages.

FIGS. 8*a*, 8*b*, 8*c*, and 8*d* illustrate the flood vent of FIGS. 1-2 with an example vertical latching mechanism. As illustrated, the flood vent 8 includes the frame 10 and the door 22, examples of which are described above with regard to FIGS. 1-2.

The flood vent 8 may provide an entry point and/or exit point in the structure for flooding fluids, such as water. In order to do so, the flood vent 8 may include a vertical latching mechanism 204 that may release the door 22, thereby allowing the door 22 to open. The vertical latching mechanism 204 may operate by sensing the level or flow of fluids, such as water, passing through the opening in the structure and, at a preset level, may release the door 22. The vertical latching mechanism 204 may include floats 212 that may be lifted and/or lowered by the height or flow of fluid. A float 212 may be configured to allow the door 22 to pivot. For example, the float 212 may have a blocker 216 positioned at the bottom of the float 212. The blocker 216 may extend out of the bottom edge 24*b* of the door via an opening (not shown). Furthermore, the blocker 216 may extend vertically below the height 224 of a baseplate 220 formed in the frame 10, so as to contact the baseplate 220 on one of the sides of the baseplate 220. As such, the blocker 216 may prevent the door 22 from pivoting when the blocker 216 is in contact with the baseplate 220. When the float 212 is lifted by fluid, the blocker 216 may also be lifted. Furthermore, when the blocker 216 is lifted above the height 224 of the baseplate 220, the door may pivot open, allowing the fluids to enter and/or exit the structure.

Figure 8A:
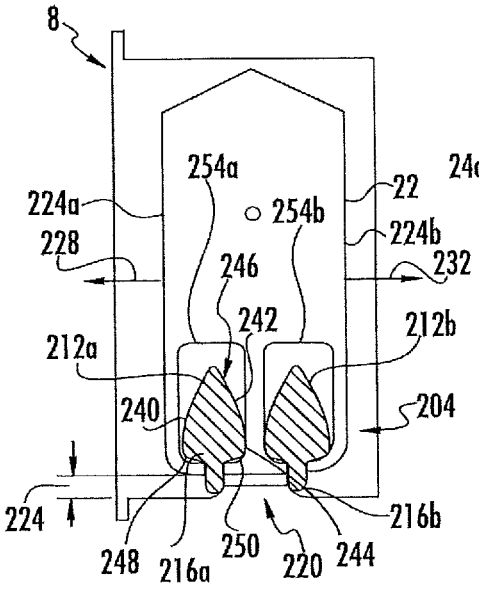
FIGS. 8*a*, 8*b*, 8*c*, and 8*d* illustrate the flood vent of FIGS. 1-2 with an example vertical latching mechanism.
Figure 8B:
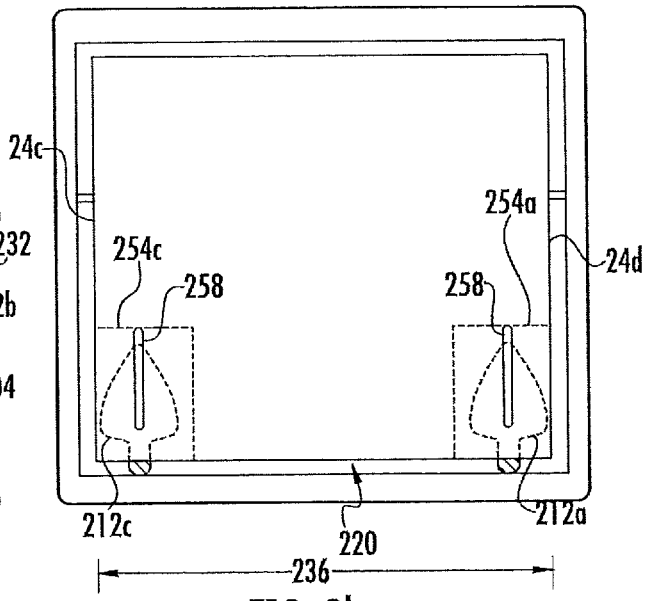

The door 22 may include at least two floats 212. The two floats 212 may be a set that operate to prevent the door 22 from pivoting open, or that may allow the door 22 to pivot open. As illustrated in FIG. 8*a*, the door 22 includes a first set of two floats: float 212*a* and 212*b*. Float 212*a* may be positioned within the door in a location that is adjacent a first face 224*a* of the door 22, while float 212*b* may be positioned within the door in a location that is adjacent a second face 224*b* of the door 22. Furthermore, floats 212*a* and 212*b* may be adjacent to each other. In particular embodiments, such a positioning may cause the float 212*a* to be located in-between the first face 224*a* and the float 212*b*, and may also cause the float 212*b* to be located in-between the second face 224*b* and the float 212*a*. The positioning of floats 212*a* and 212*b* may allow blockers 216*a* and 216*b* to be in contact with opposing sides of baseplate 220 formed as a part of the frame 10 and extending vertically into the fluid passageway by the height 224. When blockers 216*a* and 216*b* are both in contact with opposing sides of baseplate 220, the door 22 may be prevented from pivoting open. For example, when the blocker 216*b* is in contact with one of the sides of baseplate 220, the door 22 may be prevented from pivoting in a first direction 228. Similarly, when the blocker 216*a* is in contact with the other side of baseplate 220, the door 22 may be prevented from pivoting in a second direction 232. When fluids cause the blocker 216*b* to be lifted above the height 224 of the baseplate 220, however, the door 22 may pivot open in the first direction 228, allowing fluids to enter and/or exit the structure. Furthermore, when fluids cause the blocker 216*a* to be lifted above the height 224 of the baseplate 220, the door 22 may pivot open in the second direction 232, allowing fluids to enter and/or exit the structure.

The door 22 may include any number of sets of two floats 212. For example, the door 22 may include two sets, three sets, four sets, or any other number of sets. As illustrated, the door 22 includes two sets of two floats 212: a first set of floats 212*a* and 212*b*, and a second set of floats 212*c* and 212*d* (not shown). Floats 212*a* and 212*c* may be configured to prevent (or allow) the door 22 to pivot in the second direction 232, and floats 212*b* and 212*d* may be configured to prevent (or allow) the door 22 to pivot in the first direction 228. Additionally, although a set of floats 212 has been described above as including two floats 212, a set of floats 212 may include any other number of floats 212, such as three floats 212, four floats 212, five floats 212, or any other number of floats 212.

A float 212 may be positioned at any location along the length 236 of the door 22. For example, a float 212 may be positioned in the middle of the door 22, adjacent the side edge 24*c* of the door 22, adjacent the side edge 24*d* of the door 22, or any other location along the length 236 of the door 22. Each float 212 of a set of floats 212 may be located at the same location along the length 236 of the door 22. For example, as is illustrated, both floats 212*a* and 212*b* are located adjacent the side edge 24*d* of the door 22. Furthermore, one or more floats 212 of a set of floats 212 may be located at different locations along the length 236 of the door 22. For example, float 212*a* may be located adjacent the side edge 24*d* of the door 22 and float 212*b* may be located adjacent the side edge 24*c* of the door 22.

A float 212 may have any shape. As one example, the float 212 may have a paddle-like shape so that it can be displaced along a predetermined trajectory by the force of flowing fluids, such as water. As illustrated, the float 212 may have a paddle-like configuration with a front surface 240 and a rear surface 242. The front and rear surfaces 240 and 242 may be oriented substantially perpendicular to the direction of inward and outward fluid flow within the flood vent 8. As illustrated, the front and rear surfaces 240 and 242 may flare outwardly to provide a narrower upper portion 246 and a wider bottom surface 244. The front and rear surfaces 240 and 242 can intersect with the bottom surface 244 to define lower edges 248 and 250. The lower edges 248 and 250 may be any shape configured to serve as rotational points to allow the float 212 to pivot backwards or forwards on a surface. For example, the lower edges 248 and 250 may be rounded, or may be sharp corners. Additionally, as is discussed above, the float 212 may include a blocker 216, which may also have any shape.

A float 212 may be further positioned within a chamber 254 in the door 22. The chamber 254 may provide the float 212 with space to be lifted and/or lowered. Furthermore, the chamber 254 may have an opening in the bottom edge 24*b* of the door 22, which may allow the blocker 216 to extend below the bottom edge 24*b* of the door 22. The chamber 254 may have any shape and/or size. In particular embodiments, the chamber 254 may be shaped and/or sized to prevent the float 212 (and blocker 216) from becoming misaligned (which, in particular embodiments, could prevent the blocker 216 from being lowered back through the opening in the bottom edge 24*b* of the door 22). For example, the bottom of chamber 254 may be sloped to direct the blocker 216 towards the opening. The chamber 254 may further have a fluid opening 258 that may allow fluids, such as water, to enter the chamber 254, so as to lift the float 212. In particular embodiments, each chamber 254 may have its own fluid opening 258, and each chamber 254 may further not be in fluid communication inside of door 22 with any other chambers 254 (or any other chambers 254 for a set of floats 212). For example, as is illustrated in FIG. 8*a*, chamber 254*a* (which includes float 212*a*) may not be connected inside of door 22 to chamber 254*b* (which includes float 212*b*). In such an example, fluid that enters chamber 254*a* may not also enter (or be shared with) chamber 254*b* inside of door 22. Instead, chamber 254*b* may have its own fluid opening 258. In particular embodiments, by not being in fluid communication (inside of door 22) with each other, chambers 254 may prevent air from passing entirely through the door 22 via the chambers 254 and fluid openings 258. As such, the door 22 may further prevent (or substantially prevent) air from entering and/or exiting the structure.

As one example of the operation of vertical latching mechanism 204, the floats 212*a* and 212*b* (and any other floats 212, if included in the door 22) may be initially positioned within their respective chambers 254 so that blockers 216 extend out of the bottom edge 24*b* of the door, and contact opposing sides of the baseplate 220. As a result of this contact with the opposing sides of the baseplate 220, the floats 212*a* and 212*b* may prevent the door 22 from pivoting open. If a flooding event occurs outside of the structure, for example, flood waters may rise outside of the structure. Due to the rising water, the water may eventually enter chamber 254*a* through fluid opening 258. The water may cause float 212*a* to float upward (or to rise and tilt to one side), which may cause the blocker 216*a* to no longer extend below the height 224 of the baseplate 220. As a result, the door 22 may be released, and the force of the flood water may then cause the door 22 to pivot open in the second direction 232, allowing the flood water to enter the structure. Furthermore, when the flood waters recede, the reduction in force of the flood water may cause the door 22 to pivot back to a closed position. Then, when the float 212*a* is lowered, the blocker 216*a* may once again extend below the bottom edge 24*b* of the door and be in contact with one of the sides of the baseplate 220. As such, the float 212*a* may once again prevent the door 22 from pivoting in the second direction 232.

On the other hand, if a flooding event occurs inside of the structure, for example, flood waters may rise inside of the structure. Due to the rising water, the water may eventually enter chamber 254*b* through a fluid opening 258 connected to the chamber 254*b*. The water may cause float 212*b* to float upward (or to rise and tilt to one side), which may cause the blocker 216*b* to no longer extend below the height 224 of the baseplate 220. As a result, the door 22 may be released, and the force of the flood water may then cause the door 22 to pivot open in the first direction 228, allowing the flood water to exit the structure. Furthermore, when the flood waters recede, the reduction in force of the flood water may cause the door 22 to pivot back to a closed position. Then, when the float 212*b* is lowered, the blocker 216*b* may once again extend below the bottom edge 24*b* of the door and be in contact with the baseplate 220. As such, the float 212*b* may once again prevent the door 22 from pivoting in the first direction 228.

As is discussed above, vertical latching mechanism 204 may cause the door 22 to be locked vertically, as opposed to horizontally (such as occurs with typical latching mechanisms). Contrary to such typical latching mechanisms, the vertical latching mechanism 204 may prevent a flood vent from having a channel in the inner side edges of the frame to allow the pins of a horizontal latching mechanism to pass through the frame as the door rotates. As such, the vertical latching mechanism 204 may further prevent (or substantially prevent) air from entering and/or exiting the structure.

Figure 8C:
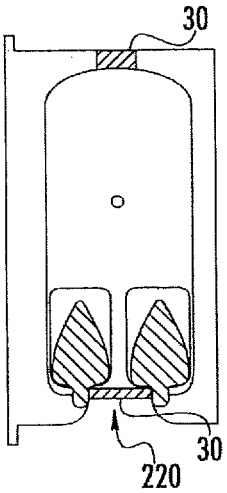
Figure 8D:
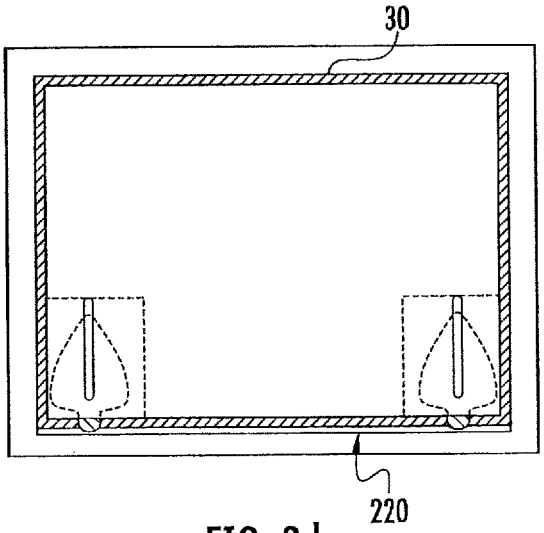

In particular embodiments, a flood vent 8 with a vertical latching mechanism 204 may also include insulation to further prevent (or substantially prevent) air from entering and/or exiting the structure, as is illustrated in FIGS. 8*c* and 8*d*. As illustrated, flood vent 8 with the vertical latching mechanism 204 may include, in particular embodiments, insulation 30, which may be positioned on one or more (or all) of the top interior edge 13*a* of the frame 10, the bottom interior edge 13*b* of the frame 10 (which may be defined by the shape and/or height 224 of the baseplate 220), the side interior edge 13*c* of the frame 10, or the side interior edge 13*d* of the frame 10. Further details and configurations of insulation 30 are discussed above with regard to FIGS. 3*a* and 3*b*. Furthermore, in particular embodiments, flood vent 8 with the vertical latching mechanism 204 may include insulation 40, which may be positioned on one or more (or all) of the top edge 24*a* of the door 22, the bottom edge 24*b* of the door 22, the side edge 24*c* of the door 22, or the side edge 24*d* of the door 22. Further details and configurations of insulation 40 are discussed above with regard to FIGS. 4*a* and 4*b*. In particular embodiments, the insulation (such as insulation 30 or insulation 40) may further prevent (or substantially prevent) air from entering and/or exiting the structure through the flood vent 8.

Modifications, additions, or omissions may be made to the flood vents 8 and interior flood vents 100 without departing from the scope of the invention. Furthermore, the disclosure of each of FIGS. 1-8 may be combined with one or more (or all) of any of the other disclosures of FIGS. 1-8. For example, the disclosure of FIGS. 8*a*, 8*b*, 8*c*, and 8*d* may be combined with one or more of the disclosures of FIGS. 5-7. As another example, the disclosures of one or more of FIGS. 3-4 may be combined with one or more of the disclosures of FIGS. 5-7.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or reorganizing any of the disclosed steps, components, elements, features, aspects, characteristics, limitations, and the like, of the various non-limiting and non-exhaustive embodiments described in this specification. In this manner, Applicant reserves the right to amend the claims during prosecution to add features as variously described in this specification, and such amendments comply with the requirements of 35 U.S.C. §§ 112(a) and 132(a).

The invention claimed is:

1. A flood vent, comprising:

a frame forming a fluid passageway through an opening in a structure; and a door pivotally mounted to the frame in the fluid passageway for allowing a fluid to flow through the fluid passageway, wherein the door comprises:

a rubber panel having a perimeter and two or more openings positioned within the perimeter of the rubber panel, each opening extending entirely through a thickness of the rubber panel; and two or more metal panels positioned within the perimeter of the rubber panel, each of the two or more metal panels being positioned within a respective opening of the two or more openings, wherein a first metal panel of the two or more metal panels comprises a first door pin that extends through a first side opening of the rubber panel and further extends into a first door slot in the frame so as to pivotally mount the door to the frame, wherein a second metal panel of the two or more metal panels comprises a second door pin that extends through a second side opening of the rubber panel and further extends into a second door slot in the frame so as to pivotally mount the door to the frame.

2. The flood vent of claim 1, wherein the two or more metal panels comprise at least four metal panels.

3. The flood vent of claim 1, wherein the two or more metal panels comprise at least six metal panels.

4. The flood vent of claim 1, wherein each of the two or more metal panels includes a female connector configured to receive a male connector included on the respective opening.

5. The flood vent of claim 1, wherein each of the two or more metal panels includes a male connector configured to fit within a female connector included on the respective opening.

6. The flood vent of claim 1, wherein the rubber panel comprises a first sheet of rubber and a second sheet of rubber, wherein the first sheet of rubber includes a first set of the two or more metal panels positioned within a perimeter of the first sheet of rubber, wherein the second sheet of rubber includes a second set of the two or more metal panels positioned with a perimeter of the second sheet of rubber, and wherein the first sheet of rubber is attached to the second sheet of rubber.

* * * * *